US011678415B2

(12) United States Patent
Bearup et al.

(10) Patent No.: US 11,678,415 B2
(45) Date of Patent: Jun. 13, 2023

(54) COMMUNICATIVE LIGHTING SYSTEM FOR A FLOOR CLEANING DEVICE

(71) Applicant: Kärcher North America, Inc., Denver, CO (US)

(72) Inventors: Adam Bearup, Lakewood, CO (US); Justin LaMar, Littleton, CO (US); Nicole Willer, Denver, CO (US)

(73) Assignee: KARCHER NORTH AMERICA, INC., Denver, CO (US)

( * ) Notice: Subject to any disclaimer, the term of this patent is extended or adjusted under 35 U.S.C. 154(b) by 292 days.

(21) Appl. No.: 16/800,956

(22) Filed: Feb. 25, 2020

(65) Prior Publication Data

US 2020/0272154 A1 Aug. 27, 2020

Related U.S. Application Data

(60) Provisional application No. 62/810,674, filed on Feb. 26, 2019.

(51) Int. Cl.
*H05B 45/20* (2020.01)

(52) U.S. Cl.
CPC ..... *H05B 45/20* (2020.01); *A47L 2201/04* (2013.01)

(58) Field of Classification Search
CPC ... H05B 45/20; A47L 2201/04; A47L 9/2852; A47L 9/2857; A47L 9/30; A47L 11/4002; A47L 11/4008; A47L 11/4011; A47L 2201/00; A47L 11/305; A47L 11/4016; A47L 11/4036; A47L 11/4044; A47L 11/4061; A47L 11/4066; A47L 11/4083; A47L 11/4088; A47L 2201/06; G05D 1/0212; G05D 2201/0215
See application file for complete search history.

(56) References Cited

U.S. PATENT DOCUMENTS 5,341,540 A 8/1994 Soupert et al.
5,581,235 A 12/1996 Hollstein
5,947,490 A * 9/1999 Munnoch ..... A47L 11/4061 180/19.1
6,059,309 A * 5/2000 Munnoch ..... B60N 2/38 280/652

(Continued)

FOREIGN PATENT DOCUMENTS

CN 207012161 12/2018
DE 102011000816 8/2012

(Continued)

OTHER PUBLICATIONS

"Avidbots", Avidbots Australia, Accessed Apr. 12, 2018.*

(Continued)

*Primary Examiner* — Jeff A Burke
*Assistant Examiner* — Blake A Wood
(74) *Attorney, Agent, or Firm* — Sheridan Ross P.C.

(57) ABSTRACT

Robotic devices are provided that can be operated in an autonomous mode. In various embodiments, the devices comprise lighting elements that are capable of displaying information to humans within a robotic environment. A variety of future and near-future actions are expressed through different operations and sequences of the lighting elements. The lighting elements further enable the device to express a current status.

10 Claims, 16 Drawing Sheets

(56) References Cited

U.S. PATENT DOCUMENTS

| | | | | |
|---|---|---|---|---|
| 6,774,596 | B1 * | 8/2004 | Bisset | G01S 17/86 318/565 |
| 7,761,954 | B2 * | 7/2010 | Ziegler | A47L 5/14 15/340.1 |
| 9,221,509 | B2 | 12/2015 | Lai et al. | |
| 9,730,566 | B2 * | 8/2017 | Pedlar | A47L 11/20 |
| 10,272,828 | B2 | 4/2019 | White et al. | |
| 2009/0244922 | A1 | 10/2009 | Hayakawa et al. | |
| 2010/0134271 | A1 | 6/2010 | Edwards | |
| 2016/0209575 | A1 | 7/2016 | Fukui et al. | |
| 2017/0049288 | A1 * | 2/2017 | Knutson | A47L 11/4083 |
| 2017/0087731 | A1 | 3/2017 | Wagner et al. | |
| 2018/0279847 | A1 * | 10/2018 | Park | A47L 11/4011 |
| 2022/0265110 | A1 * | 8/2022 | Molina Cabrera | A47L 11/4066 |

FOREIGN PATENT DOCUMENTS

| | | | |
|---|---|---|---|
| DE | 102017104690 | 9/2018 | |
| JP | 2002-345703 | 12/2002 | |
| WO | WO 2005/107559 | 11/2005 | |
| WO | WO-2008076914 A1 * | 6/2008 | B60K 35/00 |

OTHER PUBLICATIONS

English Machine Translation of JP 2002345703 A, Access Feb. 7, 2022.*

"Drawing closer to people combining robot technology and AI (expressing emotions)," Fujitsu, 2018, retrieved from https://www.fujitsu.com/global/about/resources/featurestories/2017101901.html, 3 pages.

Alves-Oliveira et al., "Meet Me Halfway: Eye Behaviour as an Expression of Robot's Language," in Artificial Intelligence for Human-Robot Interaction: Papers from the 2014 AAAI Fall Symposium, Fall 2014, pp. 13-15.

Baraka et al., "Expressive Lights for Revealing Mobile Service Robot State," in Artificial Intelligence for Human-Robot Interaction: Papers from the 2015 AAAI Fall Symposium, Fall 2015, pp. 17-23.

Baraka, "Effective Non-Verbal Communication for Mobile Robots using Expressive Lights," A Master Thesis Submitted to Carnegie Mellon University, in partial fulfillment of the requirements for the degree of Master of Science in Robotics, May 2016, 82 pages.

Bethel, "Robots without faces: Non-verbal social humanrobot interaction," A Dissertation submitted in partial fulfillment of the requirements for the degree of Doctor of Philosophy, Department of Computer Science and Engineering, College of Engineering, University of South Florida, Jun. 17, 2009, 183 pages.

Bright, "Emergency Vehicle LED Lighting: Friend or Foe?," A Master Thesis Submitted to the Faculty of American Public University In Partial Fulfillment of the Requirements for the Degree of Master of Public Administration, Jun. 2014,76 pages.

Clawson et al., "Use of Warning Lights and Siren in Emergency Medical Vehicle Response and Patient Transport," Prehospital and Disaster Medicine, Apr.-Jun. 1994, 10 pages.

Cominelli et al., "SEAI: Social Emotional Artificial Intelligence Based on Damasio's Theory of Mind," Frontiers in Robotics and AI, vol. 5, No. 6, Feb. 2018, 20 pages.

Costa et al., "Emotional Storytelling using Virtual and Robotic Agents," arXiv, vol. 1607.05327v1, Jul. 18, 2016, 14 pages.

Cuculo et al., "The color of smiling: computational synaesthesia of facial expressions," Springer International Publishing, Switzerland, 2015, 12 pages.

De Lorenzo et al., "Lights and Siren: A Review of Emergency Vehicle Warning Systems," Annals of Emergency Medicine, Dec. 1991, 7 pages.

Feldmaier et al., "Evaluation of a RGB-LED-based Emotion Display for Affective Agents," arXiv, vol. 1612.07303v1, dated Dec. 21, 2016, 6 pages.

Kupas et al., "Lights and Siren Use by Emergency Medical Services (EMS): Above All Do No Harm," U.S. Department of Transportation National Highway Traffic Safety Administration Office of Emergency Medical Services (EMS), May 2017, 98 pages.

Senart et al., "Modelling an Emergency Vehicle Early-Warning System using Real-time Feedback," International Journal of Intelligent Information and Database Systems, vol. 2, No. 2, May 13, 2008, pp. 222-239.

Song et al., "Expressing Emotions through Color, Sound, and Vibration with an Appearance-Constrained Social Robot," HRI'17, Mar. 6-9, 2017, 10 pages.

Thomaz et al., "Computational Human-Robot Interaction," Foundations and Trends in Robotics, vol. 4, No. 2-3, 2013, pp. 105-223.

Veloso et al., "CoBots: Robust Symbiotic Autonomous Mobile Service Robots," Proceedings of the Twenty-Fourth International Joint Conference on Artificial Intelligence, 2015, pp. 4423-4429.

Veloso et al., "Transparency In Robot Autonomy," School of Computer Science, Carnegie Mellon University, Jan. 5, 2017, 32 pages.

International Search Report and Written Opinion for International (PCT) Patent Application No. PCT/US2020/019731, dated Feb. 25, 2020, 23 pages.

International Preliminary Report on Patentability for International (PCT) Application No. PCT/US2020/019731, dated Sep. 10, 2021, 9 pages.

Official Action (with English translation) for China Patent Application No. 202080015532.6, dated Mar. 23, 2022, 22 pages.

Official Action for Australia Patent Application No. 2020227733, dated Jul. 22, 2022, 4 pages.

Official Action (with English translation) for China Patent Application No. 202080015532.6, dated Nov. 16, 2022, 23 pages.

Official Action for Canada Patent Application No. 3126724, dated Nov. 29, 2022, 6 pages.

Extended European Search Report for Europe Patent Application No. 20763911.3, dated Oct. 24, 2022, 7 pages.

Decision to Grant (with English translation) Japan Patent Application No. 2021-549849, dated Nov. 29, 2022, 4 pages.

* cited by examiner

COMMUNICATIVE LIGHTING SYSTEM FOR A FLOOR CLEANING DEVICE

This U.S. Non-Provisional Patent Application claims the benefit of priority from U.S. Provisional Patent Application Ser. No. 62/810,674, filed Feb. 26, 2019, the entire disclosure of which is hereby incorporated by reference.

FIELD

The present disclosure relates generally to methods and systems for collaborative robotic devices including complex machines that work or otherwise interact with human beings. In various embodiments, collaborative robots of the present disclosure comprise floor cleaning devices. Methods and systems for provision within collaborative robots are provided herein that comprise socialization and communicative features. In various embodiments, devices of the present disclosure comprise a dynamic lighting system for communicating with nearby human beings.

BACKGROUND

Robotic systems, devices, and machines are known that provide benefits in many different applications. These applications include, but are not limited to, automated or robotic floor cleaning devices. As such devices replace or supplement human users, the level of interaction between such devices and human beings is increasing. The need to safely operate these devices in populated areas (e.g. airports, hospitals, etc.) is therefore becoming more pronounced. However, known devices fail to provide suitable communication features or capabilities. For example, many devices comprise little or no ability to communicate with nearby humans or provide a simple non-dynamic visual indication of operation (e.g. a flashing light provided on a forklift while the forklift is being operated).

SUMMARY

There is a long-felt and unmet need to provide a system that is able to quickly and efficiently communicate with human beings in a robotic environment, and to alert humans to a current operating status of a device as well as upcoming maneuvers and operations of the device.

Accordingly, embodiments of the present disclosure contemplate and provide methods and systems for a robotic device to non-verbally communicate with humans that are within or will potentially be within the same environment as a robot. In some embodiments, methods and systems of the present disclosure provide for device-to-device communication wherein at least two robots within a single environment are capable of communicating with one another. While various embodiments of the present disclosure relate to floor cleaning devices, it will be expressly recognized that the inventive concepts, methods, systems and devices discussed herein are not limited to floor cleaning devices. One of ordinary skill in the art will understand that although certain embodiments and features of the present disclosure are well suited for use with ride-on floor cleaning devices (for example), such embodiments and features can be employed on other devices including, but not limited to, hand-operated vacuums, autonomous vehicles, forklifts, stationary robots, autonomous landscaping and construction equipment, aerial drones, and other such devices that comprise autonomous or semi-autonomous features. Although certain embodiments of the present disclosure contemplate providing lighting and communication features on autonomous or semi-autonomous cleaning devices, alternative embodiments contemplate providing such features and methods on various devices including, for example, a conventional vacuum and wherein the features are operable to convey various information to user. For example, in some embodiments, vacuum cleaning devices are provided that comprise the ability to transition a light of a first color or wavelength (e.g. a green color) to a light of a second color or wavelength (e.g. a red color) when a vacuum bag is full or some other status change has occurred. Embodiments of the present disclosure contemplate providing a lighting element on various devices and wherein that lighting element is operable to emit and convey more than one wavelength of the light. Such lighting elements are contemplating as changing light color to indicate to users and others that a one or more changes have occurred. Such changes are contemplated as comprising, for example, a change in battery level, a change in bag or storage state, an error condition, an unintended obstacle, and a request for assistance. In addition to or in lieu of color changes, embodiments of the present disclosure are contemplated as comprising at least one lighting element that changes at least one of intensity and pattern to indicate various status changes in the device.

U.S. Patent Application Publication No. 2017/0087731 to Wagner, et al., which is hereby incorporated by reference in its entirety, discloses a robotic arm with lighting features that convey information related to "near-future" movements of the arm. Wagner et al. fail to disclose various aspects of the present disclosure including, for example, various signaling features and systems that are useful in moving or moveable cleaning devices that may encounter various different objects, humans, etc. in their environment.

In various embodiments, a device is provided with a lighting system capable of providing a unique identifier of a needed or upcoming action. The unique identifier is contemplated as comprising a specific light emission including at least one of a unique color, intensity, or flashing animation or pattern. As used herein, the term "animation" generally refers to a variation of light over time and the term "pattern" generally refers to a distribution or activation of certain lights distributed over a physical space of a machine or device. In various embodiments, devices of the present disclosure are capable of signaling at least one of the following upcoming or near-future actions through the operation of lighting features: turning left, turning right, powering up, powering down, coming to a stop, recording a task, being assigned a task, starting a task, accelerating, navigating, ending a task, charging a battery, a waning battery level, being blocked, being blocked for an extended period of time, being interrupted, experiencing a machine status-change to sensors, actuators, software, a fault, restarting, etc. Embodiments of the present disclosure also comprise lighting elements that are operable to indicate to a human that certain tasks or functions need to be performed. Such tasks or functions include, but are not limited to a need to charge the device, a need to refill or replenish an on-board fluid, a need to service one or more components, a need to replace a cleaning device (e.g. a brush or pad located on the device), a need to clear or remove an entrained foreign object, and a need to terminate an autonomous operation in favor of a human-powered operation based on environmental conditions. Devices of the present disclosure also comprise various unique identifiers associated with a present operating status of the device. Such unique identifiers include, but are not limited to unique identifiers that indicate that a device is charging, has completed charging, is performing a cleaning operation, is in transit without cleaning, is in transit and cleaning, and other similar operations and concepts.

In certain embodiments, devices of the present disclosure are operable to provide information related to more than one device function, condition, status, etc. For example, certain embodiments of the present disclosure comprise a task status indicator. The task status indicator is contemplated as comprising a light bar that is progressively illuminated such that when half a job (e.g. cleaning a certain floor or area) is completed, one-half of the light bar is illuminated (for example). This feature and the related information that is displayed does not prevent devices of the present disclosure from also conveying additional information. For example, devices of the present disclosure are capable of further indicating an upcoming turn while simultaneously displaying information related to a task status.

In some embodiments, devices of the present disclosure comprise lighting systems that are capable of projecting and displaying information on a surface. For example, in some embodiments, devices are provided with lighting features and elements that are capable of projecting an image or word onto a ground or floor surface to indicate and provide certain information for nearby humans. The image(s) and word(s) of such embodiments may comprise, for example, caution symbols, turn indicators (e.g. arrows), and/or express instructions (e.g. "DO NOT APPROACH" or "CHARGING NEEDED"). U.S. Pat. No. 9,221,509 to Lai et al., which is hereby incorporated by reference in its entirety, discloses a lighting system that is capable of projecting images and information onto a ground surface. Various features of Lai et al. are contemplated for use in embodiments of the present disclosure.

While various embodiments of the present disclosure provide for devices with the ability to visually communicate using lighting features, devices of the present disclosure are not limited to lighting elements as a means for communication. For example, various embodiments of the present disclosure comprise speakers for emitting audio and/or features and devices for tactile communication (e.g. vibration). These aural and tactile features are contemplated as being provided in addition to visual communication means.

In various embodiments, devices of the present disclosure comprise aural and audio features to notify nearby persons of various actions. For example, it is contemplated that devices of the present disclosure comprise a speaker that is operable to provide an audible warning signal of at least two seconds in duration before moving or otherwise conducting operations. A visual warning signal is also contemplated as being provided simultaneously with the audio signal. In some embodiments, the audio signal comprises a sound level of at least about 30 dB(A) at a distance of approximately 1.50 meters.

In various embodiments of the present disclosure, lighting elements are provided on a device in the form at least one light-emitting diode ("LED"). For example, and without limitation, LED strip lights and individual LED chips are contemplated as being provided in a device and wherein the LED(s) are capable of emitting various different wavelengths and colors of light. Additionally, embodiments of the present disclosure are contemplated as comprising plasma light elements including, for example, one or more plasma strips or plasma rings. It will be recognized, however, that inventive methods and systems of the present disclosure are not limited to a particular source of light.

In various embodiments, a light guide or light pipe is provided for directing and conditioning light. In certain embodiments, light guides of the present disclosure comprise at least one of a diffusive, scattering, reflective, or refractive material. In some embodiments, a lens is provided in combination with a light guide. The lens comprises a polycarbonate infused with a refractive additive to diffuse light. In some embodiments, the light lens is provided in combination a straight light pipe (i.e. the light pipe is devoid of bends or angles), and a light lens is provided for each of the light locations on a machine. In various embodiments, light guides or pipes of the present disclosure are provided with a diffusing additive comprising a different refractive index than the host polymer (i.e. the raw material for the light pipe). In preferred embodiments, the host polymer comprises a functional medium for light transmission, and overall light transmission is further improved by the addition of the refractive additive. The additive(s) preferably comprise the ability to refract, reflect, and/or scatter light through or from the material to which the additive is applied.

In some embodiments, a light guide is provided that comprises a ninety-degree bend with an entrance and exit, and either a high-polish or diffusive internal surface. At least one LED or other light element is provided proximal to the entrance, and light emitted from the LED is conveyed through an internal conduit of the light guide and through the exit.

In various embodiments, devices of the present disclosure comprise linear light strips that operate or emit light in the visible light spectrum. These devices preferably comprise a finite refresh rate, and light intensity can be synchronized to discrete signals. In some embodiments, at least one programmable LED strip is provided. The LED strip comprises an acrylic diffuser to achieve omnidirectional visibility and is preferably in communication with and controlled by a microcontroller. NeoPixel strips such as those that are commercially available from Adafruit Industries, LLC are contemplated as being provided within devices of the present disclosure.

In one embodiment, a robotic floor cleaning device for interaction with persons in a robotic environment is provided. The device comprises a chassis comprising a front, a back, a lower surface, a front surface adjacent the front, an upper surface, a rear surface located behind a center point of the chassis, a left surface, and a right surface. At least one powered drive-wheel is provided that is operable to convey the device. A plurality of multi-colored lights is provided that are operable to be illuminated in a manner that corresponds to at least one of an upcoming action and a current status of the device. A controller is provided and is operable to cause at least some of the plurality of multi-colored lights to perform different functions. The plurality of multi-colored lights and the controller are operable to produce a unique identifier for each of: an upcoming action of the device, an error status, a task-completion status, a current action of the device, and a warning indication.

In one embodiment, a method of operating a robotic floor cleaning device for interaction with persons in a robotic environment is provided that comprises providing a device having a chassis comprising a front, a back, a lower surface, a front surface adjacent the front, an upper surface, a rear surface located behind a center point of the chassis, a left surface, and a right surface. A platform is located partially between a portion of the right surface and the left surface and at least partially behind the rear surface, wherein the platform includes a top surface adapted to receive an operator. The device compromises a plurality of multi-colored lights that are operable to be illuminated in a manner that corresponds to at least one of an upcoming action and a current status of the device. A controller is provided that is operable to cause at least some of the plurality of multi-colored lights to perform different functions. The method comprises the steps of producing a first unique identifier for an upcoming action of the device; producing a second unique identifier for an error status; producing a third unique identifier for a task-completion status; producing a fourth unique identifier for a current action of the device; and producing a fifth unique identifier for a warning indication.

In various embodiments, devices of the present disclosure are provided with and comprise a language and an ability to communicate with nearby persons. In certain embodiments, devices of the present disclosure comprise a language that is capable of conveying or communicating a plurality of different activities, status identifiers, planned actions, needs, and/or emotional states. In some embodiments, devices of the present disclosure comprise the ability to communicate at least one of the following actions or states: turning on, manual cleaning, waiting for manual use or user-input, charger being connected, charging a low battery, continuing to charge a battery, a fully charged status, in-transit, beginning and autonomous route, navigating an autonomous route, a battery level reduction, an unintended error, pausing for an obstacle, pausing for an extreme amount of time, stopping for a stowaway or unexpected passenger, an emergency stop, a left turn, a right turn, rebooting, resetting, turning off, staring a service check, ending a service check, and calibrating. In some embodiments, devices of the present disclosure comprise a separate and unique signal or identifier for each of the foregoing actions or states. Preferably, an array of different signals and identifiers are provided by unique combinations of light color, light animation (i.e. solid, blinking, or strobing), light selection, light intensity, and light combinations.

In preferred embodiments, devices of the present disclosure comprise constant communication features wherein at least some information is conveyed by lighting devices at all times while the device is in operation. For example, in certain embodiments, devices of the present disclosure comprise a status indicator light (or light sequence) that indicates all systems are functioning normally as well as the ability to provide indications of change or upcoming change in action or activity, distress and/or warning signals.

Lighting devices and associated logic of the present disclosure provide for a system, method of operation, and language that allows devices of the present disclosure to communicate a plurality of different needs, status information, warnings, and similar information. The present disclosure provides devices with non-verbal communication and language skills. In various embodiments, devices of the present disclosure are operable to convey information in a logical and intuitive manner to humans that are trained on or familiar with the device(s) and those who are not (e.g. bystanders in a public space). Systems, methods, and devices of the present disclosure therefore provide enhanced safety to nearby users, improve cleaning and operational efficiencies, and generally enhance the user-friendliness of devices as well as their integration into various environments. Although such systems, methods and devices are contemplated for use in connection with cleaning equipment in various embodiments, it is also contemplated that the embodiments of the present disclosure may be incorporated into and useful with various other devices, including autonomous or semi-autonomous devices.

In various embodiments, devices of the present disclosure comprise the ability to convey that the device is booting up or turning on. In some embodiments, for example, the device comprises a custom animation (e.g. a steady emission of light or a blinking light) comprising a white light. In some embodiments, the light action or pattern is provided for a relatively short duration, such as less than or equal to one second or while a power button or key is used to activate the device. Once the device is powered up, the action is terminated.

Devices of present disclosure are also contemplated as comprising the ability to convey information related to an ongoing or continuous use of the device. For example, in some embodiments, once the device is turned on it is capable of conveying an "on" or active status until a mode of the device changes or another message needs to be conveyed. For example, in some embodiments, a constant-intensity white light is provided from at least a portion of the device to indicate that the device is on or active. This light may operate contemporaneously with additional lights including, but not limited to, turn signals, warning lights, and service-request lights to name a few.

In various embodiments, devices of the present disclosure comprise the ability to display information related to various states of charging. For example, devices of the present disclosure comprise lighting features with the ability to indicate to nearby humans that an on-board battery is charging. In some embodiments, devices comprise a lighting animation with a duration of less than approximately two seconds and wherein the light comprises a green color (e.g. a light within a band of wavelengths of between approximately 490 nm to approximately 570 nm). It is further contemplated that devices of the present disclosure comprise the ability to provide different lighting animations, schemes, and outputs based on a current charge level of a battery or batteries. For example, when on-board batteries of the device comprise a charge level that is between 0% and 50% of the capacity of the batteries, a first charging indication is provided. When the on-board batteries are between about 51% and 99% of a capacity, a second charging indication is provided. When the batteries of the device are fully charged, a third charging indication is provided that indicates charging is complete. Preferably, the first, second and third charging indications comprise distinct indications in terms of at least one of color, pattern, animation, and intensity such that a human can readily understand a charge state of the device. In some embodiments, the first charging indication for a low battery comprises a pulsating light with a frequency of approximately 0.2 Hz and a green or light green color. The second charging indication comprises a pulsating light at a frequency of approximately 0.3 Hz with a green color such that the second indication comprises a faster pulsing light at a darker green color and thereby indicates a less urgent need to charge the device. The device further comprises a third charging indication to indicate a completion of charging and notifying a human that the device can be unplugged. In some embodiments, this indication comprises a solid green light that is distinct from both the first and second indication.

In various embodiments, devices of the present disclosure comprise the ability to indicate to humans that one or more cleaning modes are active. For example, in some embodiments, devices of the present disclosure comprise lighting features that are operable to indicate that the device is in the process of cleaning a flooring surface for as long as that particular action is occurring. In some embodiments, a white or blue light is provided at a constant, non-pulsing intensity level. The light preferably comprises a light or blue light to intuitively convey to humans that some level of "normal" (i.e. a non-error mode) activity is occurring. As will be recognized by one of ordinary skill in the art, it is not necessary that various bystanders and humans understand the exact functions being performed by a machine. For example, it is considered to be sufficient that patrons of airports understand that devices of the present disclosure are performing functions and are not in distress without conveying to such persons that the device is vacuuming, scrubbing, or burnishing (for example). However, in some embodiments, light colors, animations, and patterns are provided with sufficient specificity to convey to more highly trained personnel that the device is conducting a specific cleaning function.

In various embodiments, devices of the present disclosure comprise the ability to convey that a transport mode is activated. The transport mode may be an autonomous transport mode, or a driven or human-operated transport mode. For example, in some embodiments, devices and lighting systems of the present disclosure comprise the ability to indicate using lighting signals that the device is moving. It is contemplated that the signal associated with a transport mode is specific to transport and indicates that the device is moving but not cleaning. However, it is also contemplated that a transport signal and a cleaning signal can be operated simultaneously when both functions are active. In some embodiments, the transport signal comprises a rising and falling white light at a frequency of about 0.5 Hz.

In various embodiments, devices of the present disclosure comprise the ability to operate in an autonomous mode. For example, devices of the present disclosure are operable to navigate a pre-programmed route and/or rely on sensors and related features to navigate a route, avoid obstacles, etc. In such embodiments, it is contemplated that the device(s) comprise at least one signal to indicate to nearby humans that an autonomous route is beginning. For example, in certain embodiments, devices comprise a signal with a duration of less than or equal to about three seconds in which a light is activated to indicate to nearby humans that an autonomous route or operation is beginning. This signal provides feedback to a user that the device has registered the user's request to initiate the autonomous route and/or indicates to nearby non-users that the device is initiating an autonomous route. Preferably, this signal comprises a light in the blue wavelength spectrum and indicates activity without conveying distress or attracting undue attention.

Additionally, embodiments of the present disclosure comprise the ability to indicate that an autonomous route is in-progress. For example, in some embodiments, a rising and falling light in the blue wavelength spectrum is provided at a frequency of approximately 0.25 Hz to indicate an ongoing autonomous cleaning operation. This signal is preferably distinct from but somewhat similar to the signal that indicates the initiation of the autonomous route and is active until the route or operation is completed.

In some embodiments, devices of the present disclosure comprise the ability to signal an error state in the form of a low battery level. For example, in certain embodiments, a signal is provided to indicate to humans that a battery level has dropped below 25% of the battery capacity and therefore will soon require charging. This is signal is contemplated as being specific to and operate within a battery range that comprises 25% to 20% battery capacity, and comprises a light wavelength in the blue to violet range and a frequency of about 0.25 Hz. Devices of the present disclosure contemplate and comprise additional signals as the battery level diminishes further. For example, at least one of frequency and wavelength are contemplated as changing as the battery level drops to between 19% and 15%, 14% and 10%, and below 10% (for example). It is also contemplated that light signals associated with low-battery indications are provided by specific lights on a machine. For example, the signal for low battery level(s) is contemplated as being provided by a relatively discrete lighting element such that an indication that charging is given to users without creating a high level of alert or distress (as may be associated with substantially all of the lights on a machine operating at the same time, for example). In some embodiments, a dedicated battery-indication light is provided. This light is further contemplated as being provided proximal to a charge port or battery pack to provide a logical indication and association that the light relates to a battery and related charging needs.

In various embodiments, devices of the present disclosure comprise the ability to convey that an error is experienced by the machine. Errors that devices and machines of the present disclosure may encounter include, but are not limited to, a general inability to function, the realization of an obstacle, the realization that the device has been paused for an extreme amount of time (e.g. beyond what is typically required for the device to process a next step), the existence of an unexpected human on the device, and an emergency stop. In some embodiments, an indication of an unintended error is provided that comprises a pulsating red light with a frequency of approximately 2 Hz. This signal is conveyed or active until the error is addressed or fixed. In various embodiments, a light signal is provided for situations in which devices confront an unknown obstacle (human or otherwise) while operating in an autonomous mode. This signal, which is contemplated as being accompanied by a pause in machine operation, comprises a blinking or cycling at a frequency of about 1.5 Hz and a blue or light blue color. This signal is active for as long as the obstacle and associate pause exist (for example, approximately 5 seconds). If the device is paused for an extreme amount of time or experiences a certain number of obstacles within a predetermined amount of time (e.g. three or more pauses in 45 seconds or less), an additional error indication is provided. This error indication is contemplated as providing a light signal in the form of a cycling yellow light with a frequency of about 1.5 Hz. This light indicator is contemplated as being provided or activated by devices of the present disclosure when, for example, a device has tried to correct for an obstacle and/or re-initiate a route multiple times without success. The indicator preferably comprises a distress signal that is operable to communicate that humans should clear a path and/or qualified personnel should intervene and potentially remove the device from an autonomous mode.

In some embodiment, at least one error signal in the form of a light operation is provided to indicate that an unexpected passenger or stowaway is present on the machine. It is contemplated that devices of the present disclosure will operate in numerous different settings and environments, and it is further contemplated that unauthorized humans will attempt to ride or board devices of the present disclosure. Unexpected passengers include, but are not limited to, curious children, unruly sports fans, and persons who are authorized or qualified to operate the device(s) but have not taken the proper procedures or precautions to do so. In various embodiments, devices of the present comprise at least one sensor to detect the presence of an unexpected or unauthorized passenger, stop or pause at least one machine operation, and activate a red light to indicate that a problem exists. This signal is contemplated as remaining active until the issue is resolved. Additionally, devices of the present disclosure are contemplated as comprising an emergency stop function and an associated light indicator related to an emergency stop. In various embodiments, it is contemplated that a signal associated with an emergency stop comprises cycling at least one red or dark red light four times and then remaining constant and wherein this animation or sequence is repeated at a frequency of about 1 Hz.

In various embodiments, devices of the present disclosure comprise the ability to indicate an expected or upcoming turn. In various embodiments, an upcoming turn (e.g. as is expected by the machine based on information associated with a pre-programmed route or the detection of a need to turn) is signaled or called out for turns with angles greater than or equal to about 10 degrees. It is contemplated that turn signals of the present disclosure comprise a yellow and/or blue light on a respective side of the machine cycling at about 0.3 Hz.

In various embodiments, devices of the present disclosure comprise a signal associated with a powering-down or turning-off of the device. Such a signal is contemplated as being initiated automatically, or by a manual ignition key or switch. The signal preferably comprises a white or neutral light and may comprise various different animations. For example, an initially intense white light may be dimmed over a period of about one second to indicate a ramping or powering down of the device.

In certain embodiments, devices of the present disclosure comprise the ability to indicate to humans that a rebooting is occurring. For example, a signal is provided while a software update is processing, and a change in that signal is further provided when the processing is complete and the device is again ready for use. This signal is contemplated as comprising red, blue, and/or white light with various different animation options. For example, a lateral scrolling of a light can be provided to indicate a progress of a software installation and/or update. The signal can further comprise a sudden change when the installation and/or update is complete (e.g. sudden change from scrolling to blinking).

In various embodiments, devices of the present disclosure comprise a light signal to indicate a resetting of the device. For example, when a user manually resets the device and causes the machine to shut down and restart, a custom light animation is provided. The signal preferably comprises a white or neutral light to indicate that the user's request has been received and the device is responding accordingly.

In various embodiments, devices of the present disclosure comprise indicators or signals related to various service or servicing needs of the device(s). For example, various devices of the present disclosure are contemplated as comprising the ability to connect to a computer (e.g. via Bluetooth, USB, etc.). In some embodiments, when a computer or other diagnostic device is connected to a device of the present disclosure, and indication of the connection is provided. The indication is contemplated as comprising a white light for a short duration and may comprise a custom animation. The signal may also comprise an audible signal in combination with an emitted light. A service check or diagnostic may then be performed, and a light signal associated with this service check is provided. Separate or distinct signals are also contemplated as being associated with a completion of the service check and removal or un-pairing of the associated device. Additionally, a calibration signal is provided in various embodiments wherein lights can display all colors and necessary luminosities for approximately three seconds to indicate that sensors are correctly calibrated (for example). Devices of the present disclosure further comprise a lighting signal that is associated with a general need for maintenance or service. For example, in some embodiments, a static yellow light is provided when service is needed but the device remains in a generally operation state. In such embodiments, critical cleaning and navigation functions may proceed, but qualified personnel are provided with a warning light that maintenance or service should be performed soon (e.g. a routine check is coming due based on usage, a temperature of a certain portion of the device is not optimal, a stored on-board fluid is low, etc.). In some embodiments, this light is relatively small and is operable to convey to a user that further investigation is needed (e.g. a display screen of the device should be consulted for additional information).

It is an object of the present disclosure to provide the various signals and functions described above and wherein at least some of the signal can be operated contemporaneously. For example, floor cleaning devices of the present disclosure are provided that comprise a plurality of lighting elements distributed about the machine. The devices comprise a language and capability of conveying various information through different combinations and permutations of light source selection (i.e. location of lights used), color wavelength, intensity, and animation. Whereas known devices comprise a single light capable of emitting only a single wavelength of light and a single animation (e.g. blinking at a constant frequency), devices of the present disclosure comprise a near-infinite number of distribution, color, intensity and frequency combinations that enable the devices to possess their own language for communicating with humans. Preferably, devices of the present comprise a non-verbal language that is intuitive to users. It is also contemplated, however, that certain signals and portions of the languages described herein may require reference or consultation to an additional resource such as a user manual or an on-board display screen.

In some embodiments, devices of the present disclosure comprise the ability to emit light of at least five different colors (e.g. red, orange, yellow, green and blue), and comprise the ability to emit those light colors with at least five different animations (e.g. constant, blinking, pulsating, stepwise, and cyclical emissions of light). In such embodiments, at least twenty-five different unique signals can be generated by the device. In preferred embodiments, devices of the present disclosure comprise significantly more than twenty-five possible signals or indicia. For example, various different light animations are contemplated, and a nearly-infinite number of light colors within a wavelength range of 350 nm and 750 nm and including a white light are provided which can be combined to create a near-infinite number of signals.

In various embodiments, methods and devices of the present disclosure comprise a plurality of lighting sources or "bulbs" within a light bar or element. It is further contemplated that different patterns of the lighting sources may be varied to express different information. For example, where light bars of the present disclosure comprise five LED lights, a subset of the five lights is contemplated as being illuminated in different patterns to change the illumination intensity of the element and provide a plurality of different spatial patterns.

In some embodiments, devices are provided with a plurality of light bars or elements. In certain embodiments, devices are provided with five light bars, and each light bar comprises nine LEDs. In other embodiments, devices are provided with as few as two light bars. Light bars and elements are contemplated as being provided in the nose, hood, and platform portions of a floor cleaning device, but no limitation with respect to lighting location and distribution is provided herewith. LED elements of the light bars of the present disclosure are contemplated as being operated independently. For example, it is contemplated that illuminating a single LED of a lighting element that comprises numerous LEDs provides sufficient illumination to be seen by the human eye and convey information. Accordingly, embodiments of the present disclosure contemplate that devices can communicate and convey information by selectively activating a specific number and arrangement of LEDs (or other lighting elements) within a light bar. In some embodiments, a single LED is illuminated to convey a low battery status, and additional LEDs are sequentially illuminated to convey or signal a corresponding increase in battery charge level. Similarly, and for illustrative purposes only, it is contemplated that an error signal is communicated by providing an animation wherein outermost LEDs of a linear seat of LEDs are alternatingly illuminated with innermost LEDs, thereby creating a sequence of blinking light that is associated with a device error, for example. It is also contemplated that a scrolling animation is provided by the selective illumination of individual LEDs within a light bar. A turn signal, for example, is contemplated as being provided by sequentially illuminating adjacent LEDs. Furthermore, in addition to altering the total luminosity or intensity of a light bar, the intensity of an individual LED can be varied to convey information.

As shown and described herein, various embodiments of the present disclosure comprise light pipes provided with diffusive additives. It is contemplated that a partial illumination of a light bar (i.e. the illumination of fewer than all of the LEDs provided in a light bar) provides sufficient illumination for light to be diffused across light pipes of the present disclosure. It is contemplated that different additives with different diffusivities are provided, particularly where it is desired to operate light elements at low intensity levels.

No limitation with respect to the number of LEDs (or other lighting elements) is provided herewith. In embodiments that comprise the ability to selectively illuminate discrete LEDs within a single lighting element of light bar, various numbers of LEDs are contemplated and one of ordinary skill in the art will recognize that the number of animations, patterns, and amount of information that can be conveyed by a light bar will increase with the number of LEDs provided within a light bar.

In various embodiments of the present disclosure, devices are provided with at least one controller. Controllers of the present disclosure are provided in communication with various features within a device including, but not limited to lighting elements. In various embodiments, at least one controller is provided to enable autonomous or semi-autonomous operation of the device. In addition to being operable to send signals to various portions of the device (e.g. signaling a motor associated with a steering column to take various actions), the controllers are also operable to receive information from portions of the device. For example, a motor associated with a drive wheel is operable to send and receive information to one or more controllers such that when the drive wheel encounters unexpected resistance (for example), the controller(s) receive related information and signal the device to take corrective action. Corrective action includes, but is not limited to, illuminating or animating various lighting features as shown and described herein.

In various embodiments of the present disclosure, devices are provided with a main control board that is operable to control various device functions. Such functions include controlling various pumps, motors, and vacuum devices in embodiments where the devices comprise floor cleaning machines. In some embodiments, a vehicle control unit ("VCU") is provided that is operable to receive signals and information from various components of a device. The VCU is further operable to send signals to lighting feature as shown and described herein. Preferably, the VCU is operable to interpret signals received from at least one additional controller, create a pattern or animation signal associated with certain information, and send signals to light bars and/or LEDs provided on the device (e.g. via a serial peripheral interface). The light bars or LEDs preferably receive DC power from on-board power supply to carry out signal commands from the VCU. VCUs of the present disclosure preferably comprise a memory that is operable to store information related to various different patterns and animations as shown and described herein.

VCUs of the present disclosure are operable to receive information from various sources. For example, VCUs of the present disclosure are operable to receive signals from on-board controllers and modules that a drive wheel and associated motor have met unexpected resistance, and/or that a charge port of the device is connected and is receiving power from an external source. The VCU is further operable to send signals to at least one control board associated with a light bar or LED, and wherein the signal being sent comprises a command related to at least one of lighting pattern and an animation.

In certain embodiments, a human machine interface ("HMI") is provided in communication with one or more controllers of the device, such as the VCU. HMIs of the present disclosure are contemplated as comprising a memory, including memory for display content of a graphical user interface. The HMI is provided in communication with the VCU in various embodiments. Various embodiments of the present disclosure comprise a serial peripheral interface such as a CAN Bus that is capable of communication with a plurality of controllers. As will be recognized, the CAN Bus allow for communication between various different controllers and devices and, in some embodiments, can accommodate up to 124 different controllers.

It should be recognized that the present disclosure is not limited to a particular controller architecture, or to a specific number or arrangement of controllers. Inventive aspects of the present disclosure are provided herein that are independent of controller layout. The foregoing is provided to illustrate and describe the architecture of certain contemplated embodiments and should not be viewed as limiting.

This Summary is neither intended nor should it be construed as being representative of the full extent and scope of the robotic devices and floor cleaners of the present disclosure. The present disclosure is set forth in various levels of detail in the Summary as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

The above-described embodiments, objectives, and configurations are neither complete nor exhaustive. As will be appreciated, other embodiments of the invention are possible using, alone or in combination, one or more of the features set forth above or described in detail below.

The phrases "at least one," "one or more," and "and/or," as used herein, are open-ended expressions that are both conjunctive and disjunctive in operation. For example, each of the expressions "at least one of A, B, and C," "at least one of A, B, or C," "one or more of A, B, and C," "one or more of A, B, or C," and "A, B, and/or C" means A alone, B alone, C alone, A and B together, A and C together, B and C together, or A, B, and C together.

The term "a" or "an" entity, as used herein, refers to one or more of that entity. As such, the terms "a" (or "an"), "one or more," and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C. § 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

BRIEF DESCRIPTION OF THE DRAWINGS

The accompanying drawings, which are incorporated in and constitute a part of the specification, illustrate embodiments of the invention and together with the Summary given above and the Detailed Description of the drawings given below, serve to explain the principles of these embodiments. In certain instances, details that are not necessary for an understanding of the invention or that render other details difficult to perceive may have been omitted. It should be understood, of course, that the invention is not necessarily limited to the particular embodiments illustrated herein. Additionally, it should be understood that the drawings are not necessarily to scale.

Similar components and/or features may have the same reference label. Further, various components of the same type may be distinguished by following the reference label by a letter that distinguishes among the similar components. If only the first reference label is used, the description is applicable to any one of the similar components having the same first reference label irrespective of the second reference label.

DETAILED DESCRIPTION

Figures 1A, 1B:
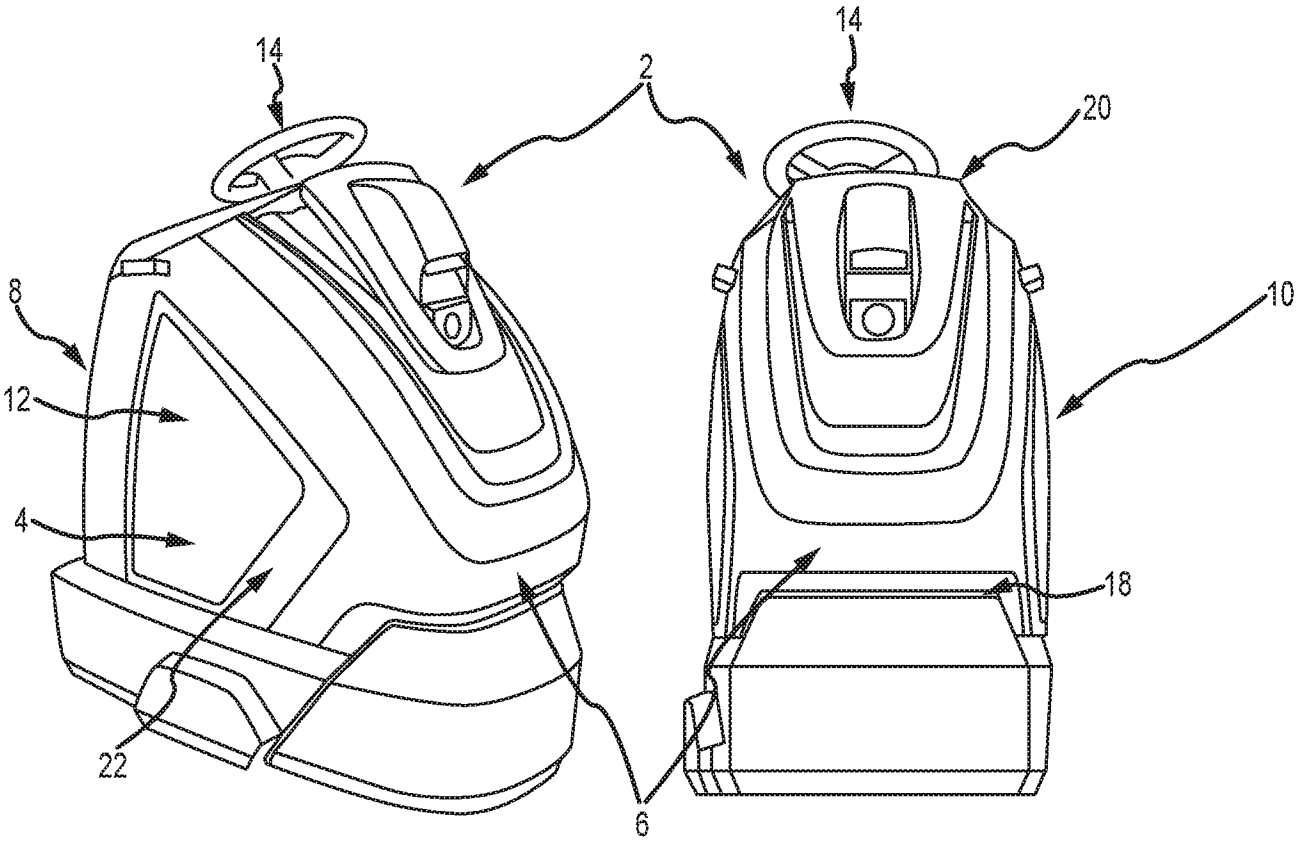
FIG. 1A is a front perspective view of a device with communicative features according to one embodiment of the present disclosure.
FIG. 1B is a front elevation view of the device of the embodiment of FIG. 1A.

FIG. 1A is a perspective view of a floor cleaning device 2 according to one embodiment of the present disclosure. FIG. 1B is a front elevation view of the device 2 of FIG. 1A. As discussed, methods, systems, and features of the present disclosure that allow a device to communicate with other devices and human beings are not limited to use with floor cleaning devices. The embodiment of FIGS. 1A-1B, however, provides a floor cleaning device 2 that comprises a device which can operate in a human-controlled, semi-autonomous, or fully-autonomous mode. The device 2 comprises a chassis 4 having a front 6, a rear 8, and left and right side portions 10, 12 that collectively make up an envelope of the device 2. The device 2 comprises a platform at the rear of the device and a steering wheel 14 or similar user-interface for controlling the device when the device is provided in a human-controlled mode. The device 2 further comprises the ability to operate without an onboard user, and in an autonomous mode wherein the device 2 is capable of navigating and cleaning a space automatically. U.S. Patent Application Publication No. 2006/0253224 to Tani et al., which is hereby incorporated by reference in its entirety, discloses a self-guided cleaning robot. Various features, devices and methods of Tani et al. are contemplated for use in embodiments of the present disclosure.

Although not shown in FIGS. 1A-1B, devices of the present disclosure are contemplated as comprising various cleaning devices on a lower portion of the device. These cleaning devices include, for example, pads, brushes, burnishers, vacuum elements, etc. It is also contemplated that a lower portion of the device 2 comprises at least one wheel on an underside of the device that is operable to power, convey and/or steer the device 2.

The device 2 comprises various lighting features. As shown, the device 2 comprises side panels, a forward lighting element 18, and an upper lighting element 20. Devices of the present disclosure, however, are not limited in number, size, spacing and arrangement of lighting elements. In FIGS. 1A-1B, for example, the lighting elements preferably comprise LED lighting elements that are partially recessed within a body portion of the device 2 to create an aesthetically pleasing appearance. Angled recesses 22 are provided on the body member of the device 2 to convey and diffuse light from the LED element(s).

The lighting elements of various embodiments of the present disclosure comprise the ability to convey information. For examples, in various embodiments, the device 2 comprises a controller and programmed logic to operate the lighting element(s) of the device in order to provide function-specific signals of at least one of an operating status of the device, a presently-occurring action of the device, an upcoming action of the device, a task-completion status, and/or a present need of the device (e.g. intervention or maintenance from a human being).

Figures 2A, 2B:
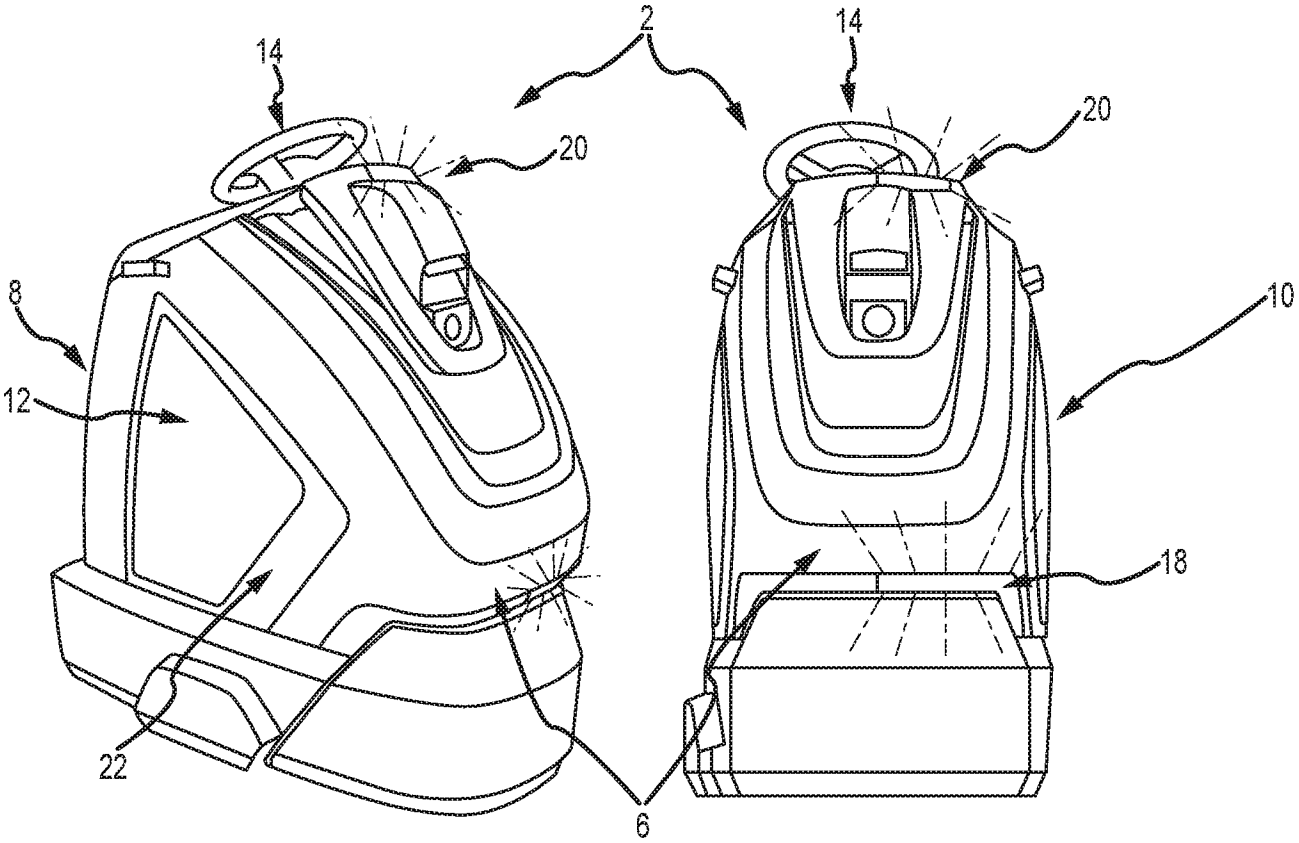
FIG. 2A is a front perspective view of the device of the embodiment of FIG. 1A.
FIG. 2B is a front elevation view of the device of the embodiment of FIG. 1A.
Figures 3A, 3B:
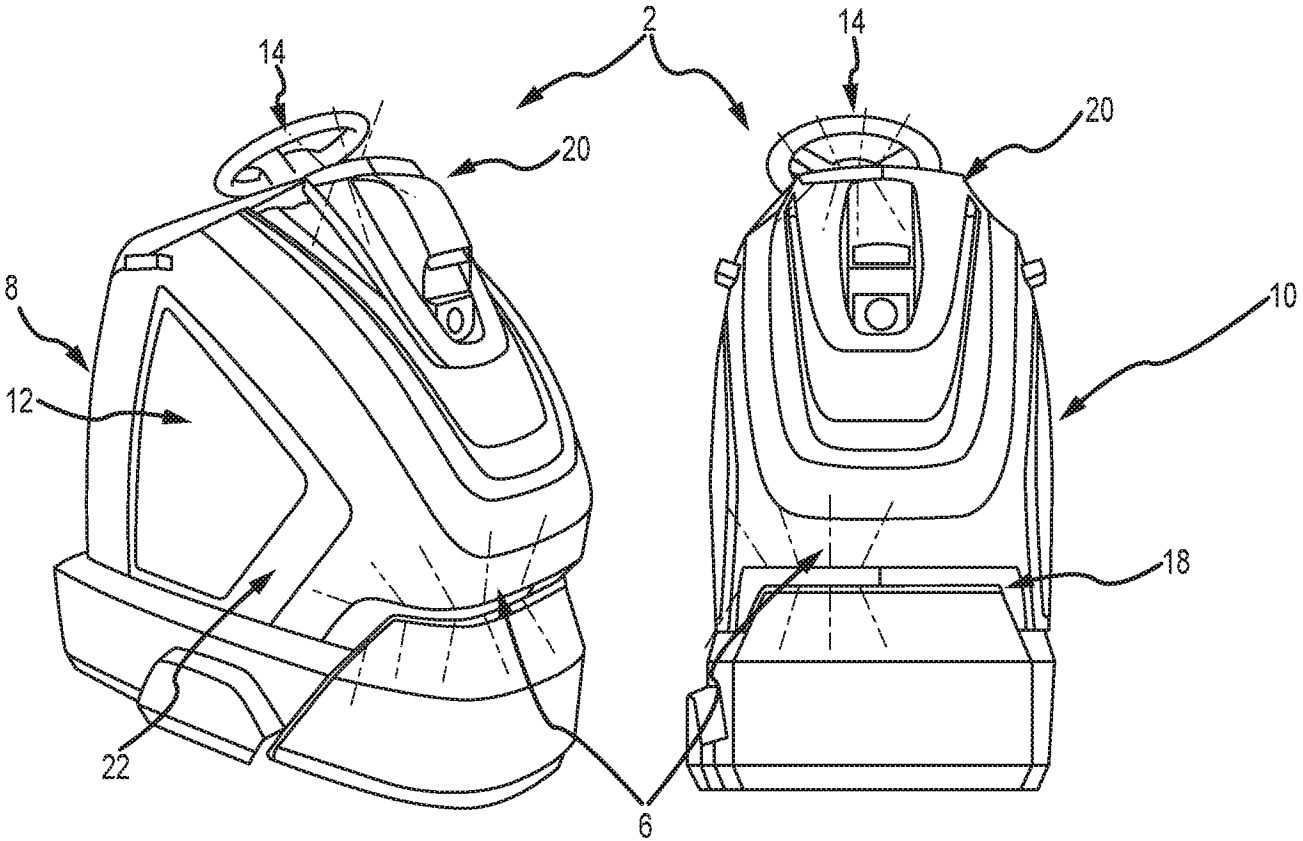
FIG. 3A is a front perspective view of the device of the embodiment of FIG. 1A.
FIG. 3B is a front elevation view of the device of the embodiment of FIG. 1A.

As shown in FIGS. 2A-2B, the device 2 is operating a portion of an upper lighting element 20 and a portion of a forward light element 18 to indicate to human beings that may be in the cleaning environment that the device is about to perform a left turn. This information is conveyed by flashing or toggling a left portion of the upper lighting element 20 and forward lighting element 18 in a manner that is logical and intuitive a human and which is known to be associated with a left turn. Similarly, FIGS. 3A-3B illustrate a device 2 that is announcing or indicating an upcoming right turn by flashing an opposite side of the upper lighting element 20. In some embodiments, directional indicators are provided by using a yellow light, which is commonly associated with a turn or caution indicator.

Figures 4A, 4B:
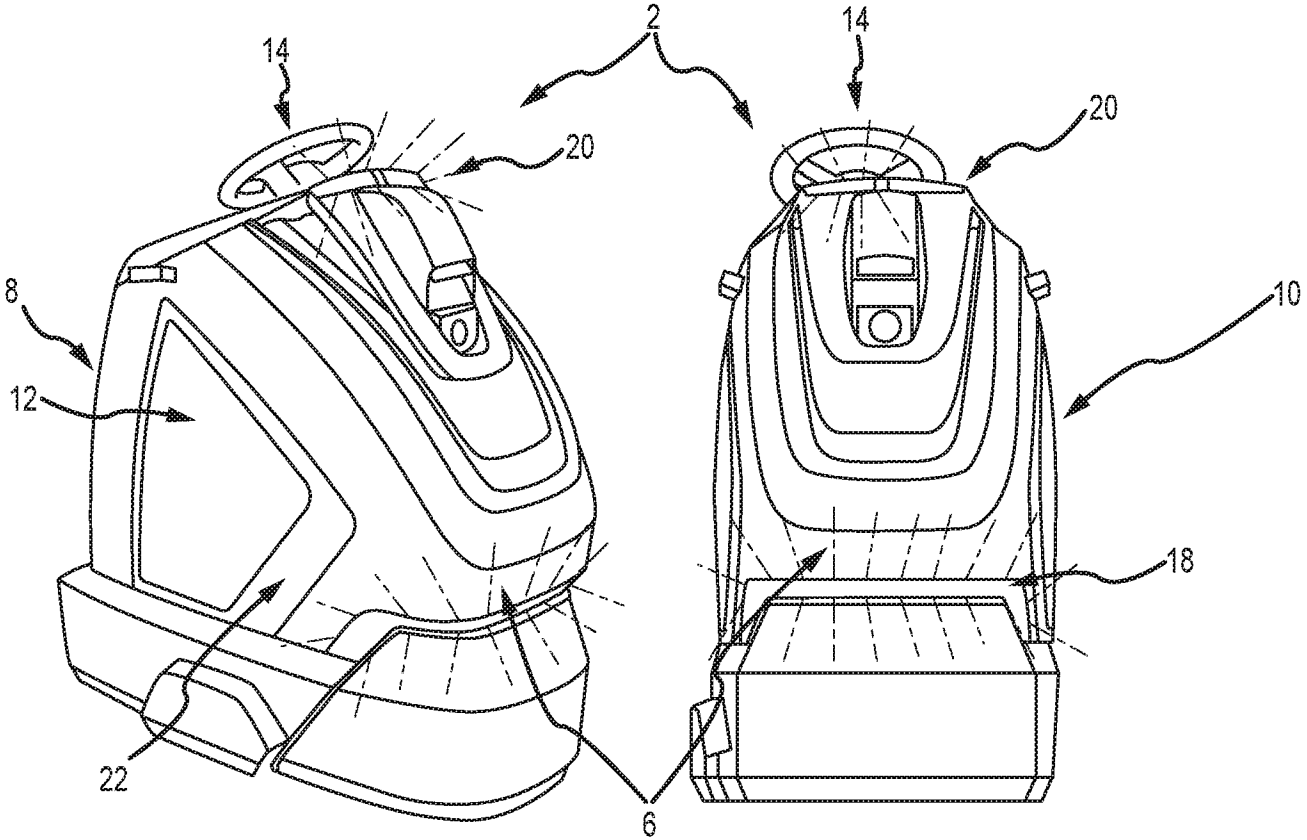
FIG. 4A is a front perspective view of the device of the embodiment of FIG. 1A.
FIG. 4B is a front elevation view of the device of the embodiment of FIG. 1A.

FIGS. 4A-4B illustrate the operation of lighting elements on a device 2 to indicate an active cleaning operation is occurring. As shown, the device 2 comprises forward 18 and upper 20 lighting elements. In the depicted embodiments, these elements are active during a cleaning operating and preferably pulse in a noticeable manner. The pulsing preferably comprises a relatively low-frequency (e.g. 0.5 Hz) that is operable to draw attention from humans without indicating a state of emergency or danger that is associated with higher frequency flashing or pulsing (e.g. greater than or equal to 1.0 Hz). In preferred embodiments, the light color used for indicating an ongoing cleaning operation comprises a neutral color that is separate and distinct from turning indicator lights and emergency stop lights (for example). In some embodiments, a light in the blue spectrum is emitted during standard cleaning operations and wherein all systems are operating normally. Although not illustrated in FIGS. 4A-4B, additional lighting elements such as side panel lighting elements may be illuminated to indicate that a cleaning operation is occurring (and/or to indicate other activities or states).

Figure 5C:
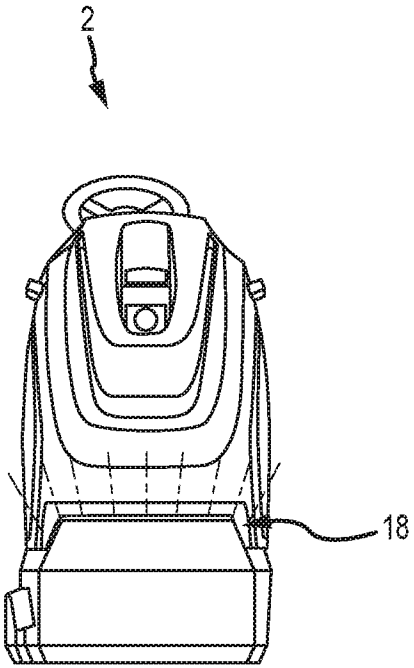
FIG. 5C is a front elevation view of the device of the embodiment of FIG. 1A.
Figure 5B:
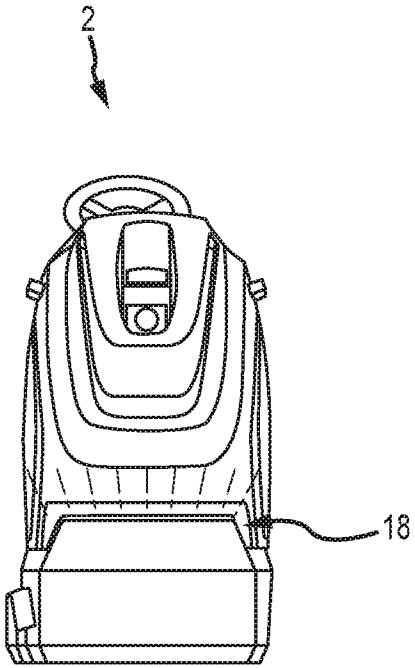
FIG. 5B is a front elevation view of the device of the embodiment of FIG. 1A.
Figure 5A:
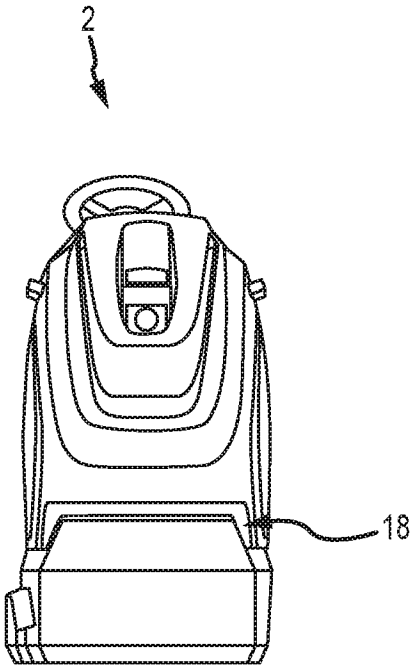
FIG. 5A is a front elevation view of the device of the embodiment of FIG. 1A.

FIGS. 5A-5C depict a device 2 of the present disclosure providing a warning indication to nearby persons. As shown in FIGS. 5A-5B, the device 2 comprises at least one forward lighting element 18 that is pulsed to provide a warning signal. As shown in the progression provided by FIGS. 5A, 5B and 5C, a light gradually increases and decreases in intensity. Preferably, the sequence, maximum intensity, and color of the light emitted during the warning indication provided in FIGS. 5A-5C are different from that provided in the cleaning operation of FIGS. 4A-4B (for example). In various embodiments, devices of the present disclosure comprise a controller and built-in logic to selectively activate certain lighting features and operations at appropriate times. For example, it is contemplated that devices of the present disclosure comprise cameras and/or proximity sensors and warning indicia are only provided if and when the device detects that humans are within a certain radius relative to the device. Similarly, the device may conserve power by reducing lighting functions and features when it is known that humans are not within a certain area (e.g. the device may determine that humans are not present while operating within a school building after-hours and thus reduce or eliminate lighting operations).

Figure 6A:
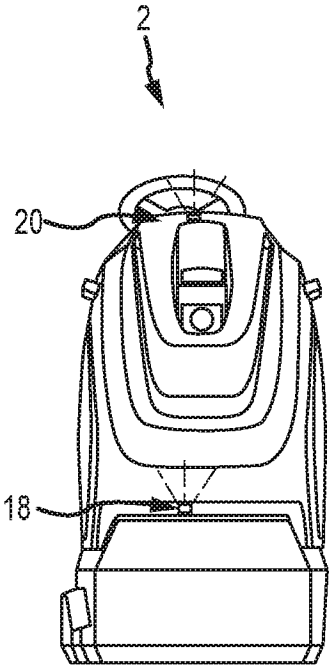
FIG. 6A is a front elevation view of the device of the embodiment of FIG. 1A.
Figure 6B:
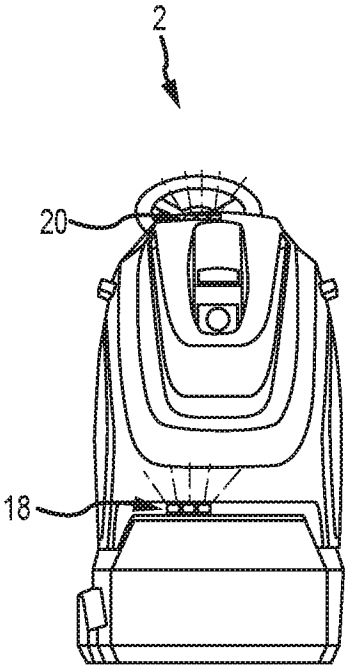
FIG. 6B is a front elevation view of the device of the embodiment of FIG. 1A.
Figure 6C:
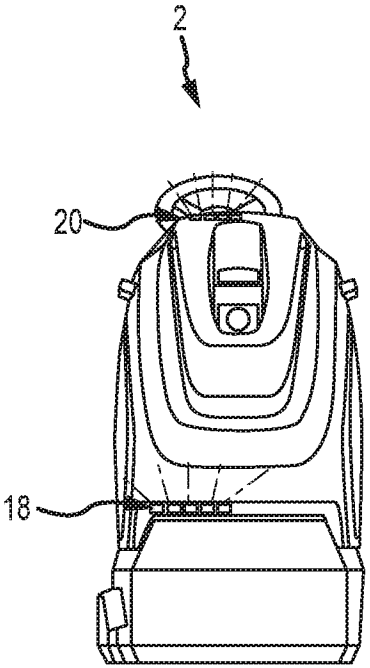
FIG. 6C is a front elevation view of the device of the embodiment of FIG. 1A.

FIGS. 6A-6C illustrate a device 2 of the present disclosure operating a dynamic signaling function. As shown, the device 2 comprises a lower lighting element 18 an upper lighting element 20 that are operated in a manner to indicate a dynamic operation. For example, a progressively increasing light as shown through the progression of FIGS. 6A-6C is operable to indicate to a user that the device is charging. A static emission of light is operable to indicate a fluid fill level. For example, the condition shown in FIG. 6B is operable to indicate that a fluid collection vessel on-board the device comprises a certain fill level (e.g. ⅗ full).

Figure 7:
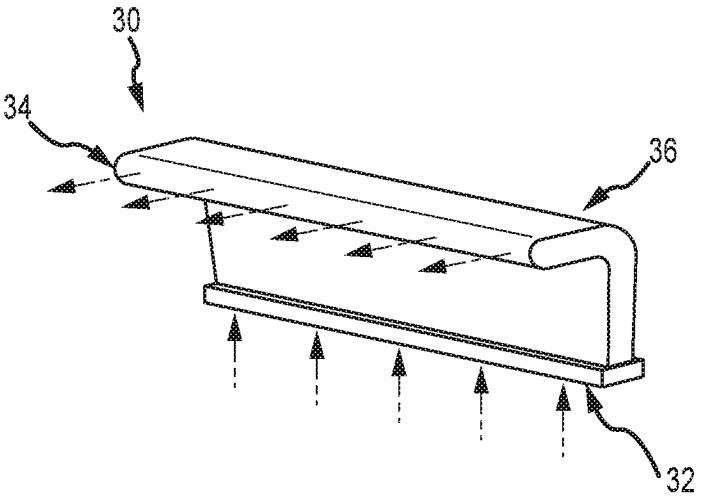
FIG. 7 is a perspective view of a light guide according to one embodiment of the present disclosure.

FIG. 7 is a perspective view of a light guide 30 or light pipe according to one embodiment of the present disclosure. As shown, the light guide 30 comprises an inlet 32 and an outlet 34. The inlet 32 and outlet 34 comprise points of ingress and egress for light, respectively. The inlet and outlet comprise light-permeable features and may, but do not necessarily comprise apertures. The light guide 30 further comprises an angle or bend 36. The bend 36 of the embodiment of FIG. 7 comprises a ninety-degree bend such that the outlet 34 is positioned orthogonal to the inlet 32. In various embodiments, light guides of the present disclosure comprise conduits for directing light from a source (e.g. LED). Preferably, the light guides comprise a smooth, high-polish interior surface to maximize light transmission.

Figure 8:
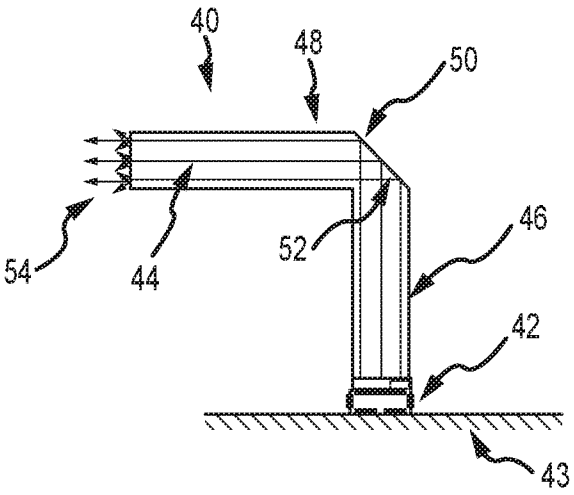
FIG. 8 is a cross-sectional view of a light guide according to one embodiment of the present disclosure.

FIG. 8 is a cross-sectional plan view of a light guide 40 according to one embodiment of the present disclosure. As shown, the light guide 40 is provided in combination with at least one lighting element 42. The lighting element 42 of FIG. 8 comprises a LED lamp provided on a circuit board 43. The light guide comprises an internal conduit 44 including a first portion 46 connected to a second portion 48, and wherein the first and second portions are provided orthogonal to one another. A bend 50 is provided. As shown, the bend 50 comprises a ninety-degree bend with an internal surface 52 that comprises a forty-five degree angle with a reflective, prismatic internal surface to redirect light energy from the first portion 46 to the second portion 48. Light is allowed to exit the light guide at an outlet 54, which may be provided with one or more lenses to create a desired visual effect. Lens location may be varied. For example, embodiments of the present disclosure contemplate providing one or more lenses at various locations along a path of light emitted from a LED or similar light source. A lens may be provided directly in front of a light source and need not necessarily be positioned at an opposite end of a light guide relative to the light source.

Figures 9A, 9B, 10A, 10B:
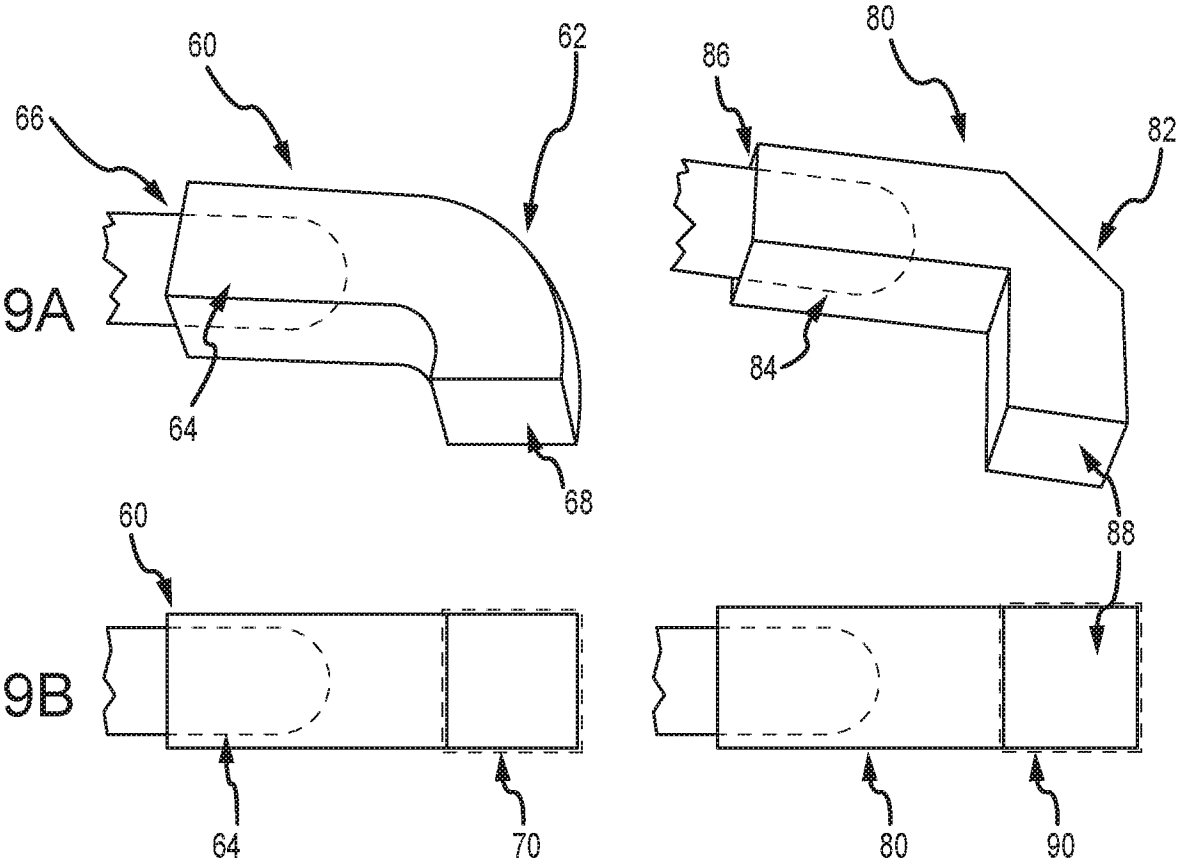
FIG. 9A is a perspective view of a light guide according to one embodiment of the present disclosure.
FIG. 9B is a plan view of the light guide of the embodiment of FIG. 9A.
FIG. 10A is a perspective view of a light guide according to one embodiment of the present disclosure.
FIG. 10B is a plan view of the light guide of the embodiment of FIG. 10A.

FIG. 9A is a perspective view of a light guide 60 according to one embodiment of the present disclosure. As shown, the light guide 60 of FIG. 9A comprises a ninety-degree bend 62 formed by a curvilinear portion of the light guide 60. A lighting element 64 is provided in combination with an inlet 66 of the light guide. An outlet 68 of the light guide is provided substantially orthogonal to the inlet 66. FIG. 9B is a plan view of the light guide 60 of FIG. 9A, with the exit area 70 of the light guide 60 shown in detail. As shown, a curvilinear and concave interior surface of the bend 62 provides for a certain amount of reflection, refraction and transmission of light from the inlet 66 to the outlet 68. The exit area 70 emits light generated by the source 64. However, the transmission of light from the source 64 to the outlet 70 is partial or incomplete.

FIG. 10A is a perspective view of a light guide 80 according to one embodiment of the present disclosure. As shown, the light guide 80 of FIG. 10A comprises a ninety-degree bend 82 formed by an angled portion of the light guide 80. A lighting element 84 is provided in combination with an inlet 86 of the light guide. An outlet 88 of the light guide is provided substantially orthogonal to the inlet 86. FIG. 10B is a plan view of the light guide 80 of FIG. 10A, with the exit area 90 of the light guide 80 shown in detail. As shown, an angled interior surface of the bend 82 (e.g. a planar surface provided at 45 degrees relative to incoming light) provides for a certain amount of reflection, refraction and transmission of light from the inlet 86 to the outlet 88. The exit area 90 emits light generated by the source 84. The provision of the angled interior planar portion of the light guide 80 provides for a fuller and more complete transmission of light, at least as compared to the embodiment of FIGS. 9A-9B. Light guide elements are contemplated for use with various embodiments of the present disclosure. In various preferred embodiments, light guide elements in accordance with the embodiment of FIGS. 10A-10B are provided within cleaning machines (for example). It is further contemplated, however, that the light guide 60 of FIGS. 9A-9B are provided in devices of the present disclosure, particularly where it is desirable to emit a softer or less intense amount of light from a light source.

Figure 11:
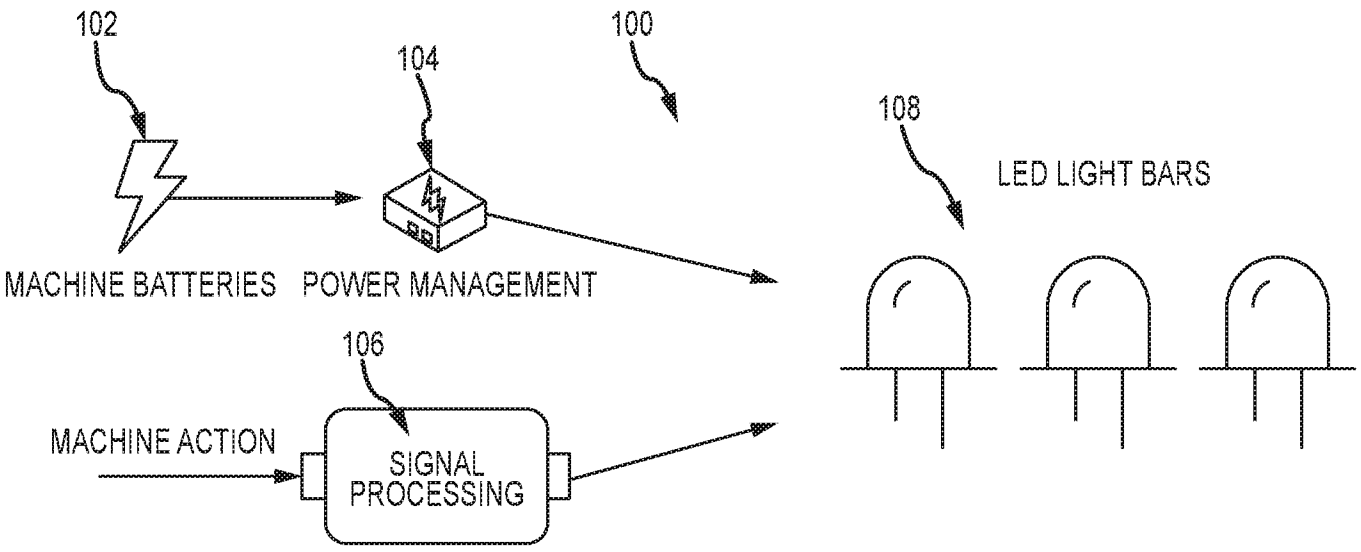
FIG. 11 is a schematic of lighting elements and related features according to one embodiment of the present disclosure.

FIG. 11 is a schematic of a portion of a lighting system 100. As shown, the system 100 comprises a power source 102. In various embodiments, the power source 102 comprises at least one rechargeable battery provided on or in a floor cleaning device. The power source 102 is connected to a power management device or controller 104, and to a lighting element 108. As discussed, the lighting elements of the present disclosure preferable comprise one or more LEDs. As shown a signal processor 106 is provided. The signal processor 106 is operable to receive various information from a cleaning machine (e.g. signals related to battery status, velocity of the device, information regarding nearby humans and objects, etc.) and control at least one of intensity and color of the lighting element 108.

Figure 12:
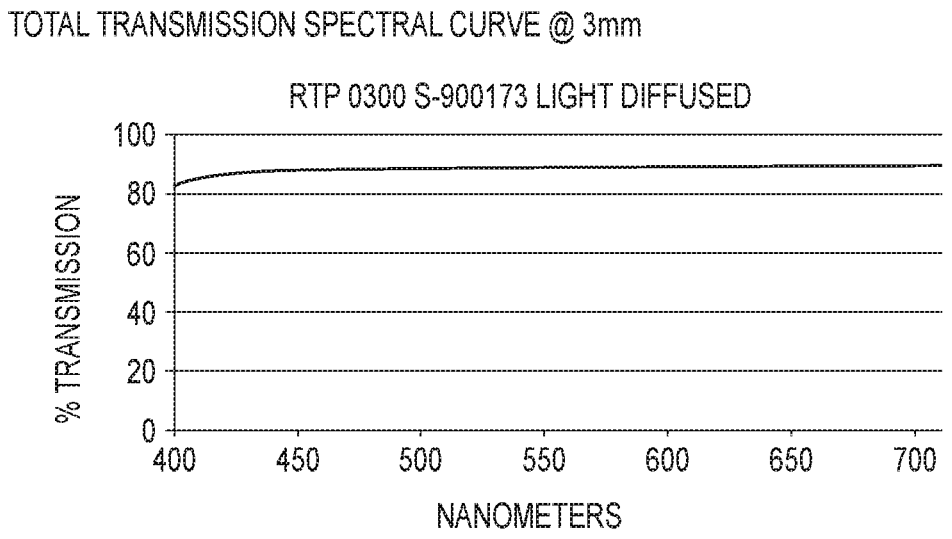
FIG. 12 is a plot showing light transmission percentage as a function of wavelength for a material contemplated for use with certain embodiments of the present disclosure.
Figure 13:
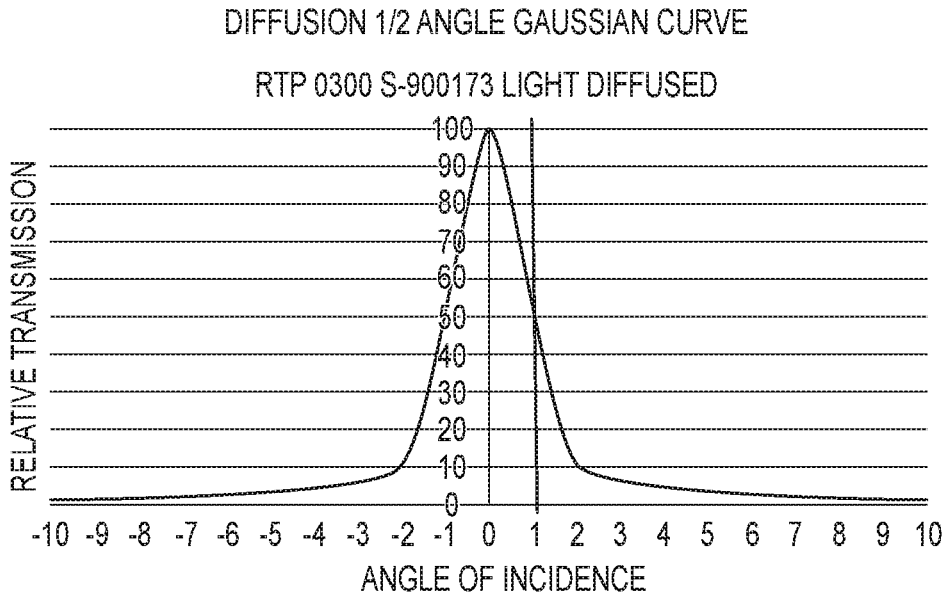
FIG. 13 is a plot showing light transmission percentage as a function of an angle of incidence for light pipes according to certain embodiments of the present disclosure.

FIG. 12 is a plot showing light transmission percentage as a function of wavelength for a material contemplated for use with certain embodiments of the present disclosure. In various embodiments, a diffusing additive is provided on at least portions of a light pipe or light guide. One refractive additive contemplated for use with embodiments of the present disclosure is a commercially-available additive from RTP Co. (RTP 0300 S-900173). As shown in FIG. 12, this additive allows for between approximately 80% and 90% transmissivity for light in the wavelength range of 400 to 700 nm. FIG. 13 is a plot of light transmissivity as a function of angle of incidence for at least the additive contemplated for use with embodiments of the present disclosure. As shown, angles of incidence at or below 1 degree provide for optimal light transmission with percentages ranging from approximately 50% at 1 degree and increasing substantially linearly to 100% transmissivity where no angle of incidence is provided.

Figure 14:
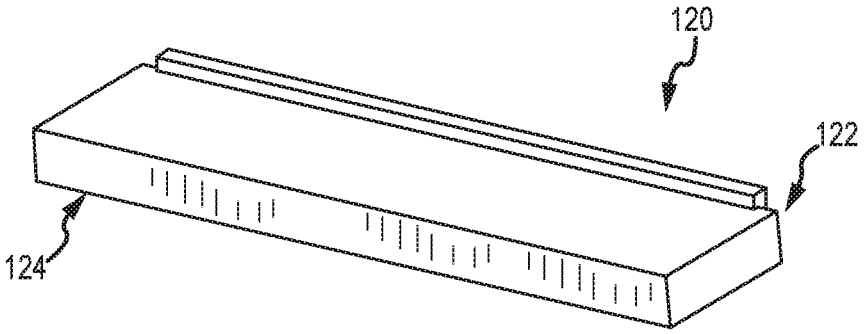
FIG. 14 is a perspective view of a light pipe according to one embodiment of the present disclosure.

FIG. 14 is a perspective view of a light pipe 120 according to one embodiment of the present disclosure. As shown, the light pipe 120 comprises a generally straight light pipe that is devoid of bends or angles along a light path. The light path is generally defined as the depth of the light pipe 120, between a rearward portion 122 and a forward portion 124. Preferably, at least one lighting element (e.g. LED) is provided at or proximal to the rearward portion 122, and at least one lens is provided on the forward portion 124 of the light pipe. In various embodiments, at least one light guide 120 as shown in FIG. 14 is provided at each of the light locations on a machine.

Figure 15:
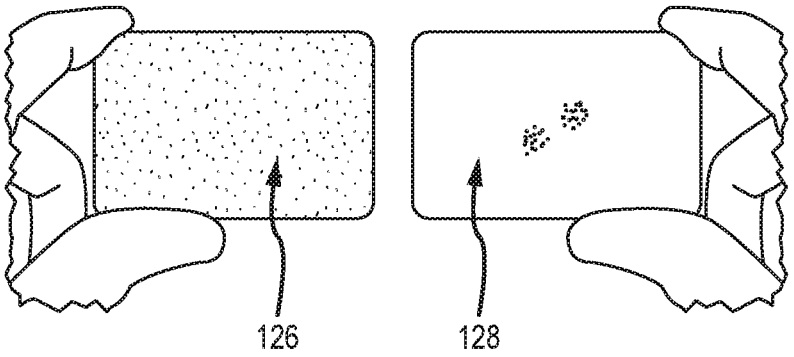
FIG. 15 is an elevation view of diffusive materials contemplated for use with embodiments of the present disclosure.

FIG. 15 is an elevation view of diffusive materials contemplated for use with embodiments of the present disclosure. Specifically, a first material 126 is provided that comprises a polycarbonate material infused or coated with a refractive additive to diffuse light. For comparison and illustrative purposes, a second material 128 is provided that is devoid of an additive. As shown, the first material 126 comprises an enhanced light distribution that is more homogeneous and generally more aesthetically pleasing than the second material 128.

Figure 17:
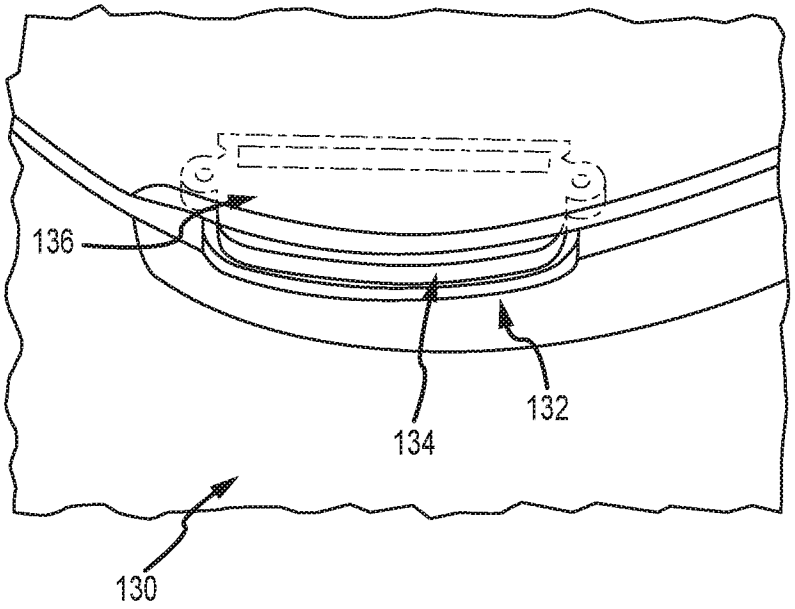
FIG. 17 is a perspective view of a light pipe incorporated into a cleaning device in accordance with one embodiment of the present disclosure.
Figure 16:
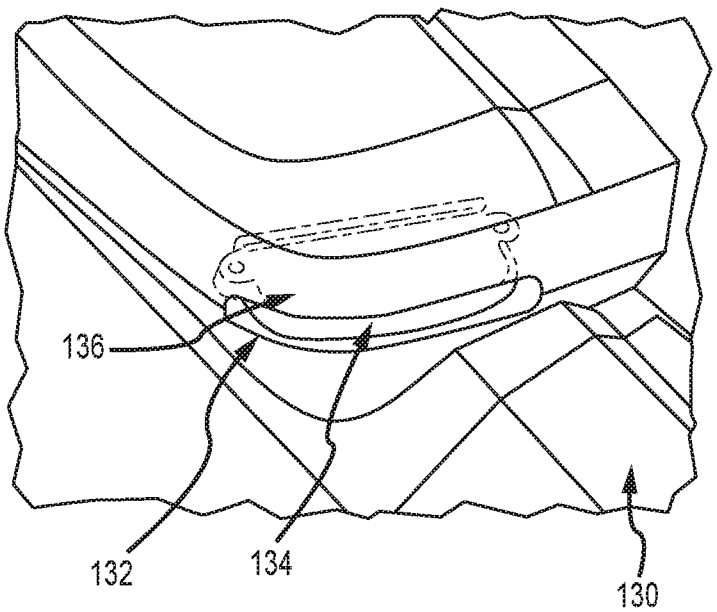
FIG. 16 is a perspective view of a light pipe incorporated into a cleaning device in accordance with one embodiment of the present disclosure.

FIGS. 16-17 are a perspective views of a light pipe 132 incorporated into a cleaning device 130 in accordance with one embodiment of the present disclosure. As shown, the light pipe 132 is integrated into one or more corners of a chassis of a cleaning device. The light pipe 132 comprises a straight light pipe devoid of corners or bends along a light path and comprises a body portion 136 and a lens 134. The lens 134 comprises an elongate lens with a curvature and/or rounded corners. However, various sizes, shapes, and orientations are provided for light guides and lenses of the present disclosure. As shown in FIGS. 16-17, the light pipes 132 comprise elongate or thin lighting elements that do not significantly change an overall appearance of the machine, and which are, or which can be at least partially recessed within a portion of a chassis of the device 130.

Figure 18:
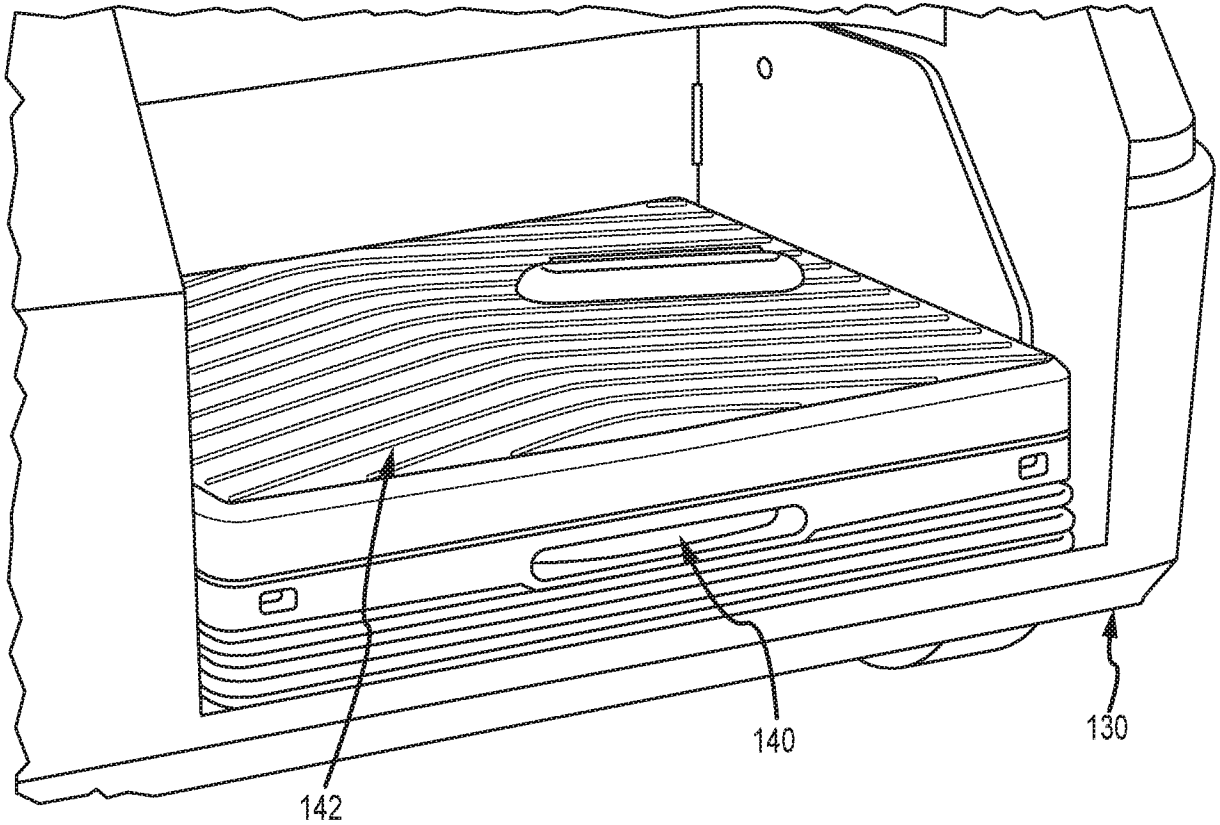
FIG. 18 is a perspective view of a light element incorporated into a cleaning device in accordance with one embodiment of the present disclosure.

FIG. 18 is a perspective view of a light element 140 incorporated into a cleaning device 130 in accordance with one embodiment of the present disclosure. A rear portion of a cleaning device 130 is shown in FIG. 18, and wherein the rear portion comprises a platform 142 for receiving a user. Devices of the present disclosure may be provided with or without a chassis. For example, fully autonomous devices of the present disclosure are contemplated as being devoid of a platform. Regardless of whether or not a platform is provided, at least one rear-facing light element 140 is provided. The light element 140 preferably comprises a light pipe as shown and described herein, wherein at least a portion of the light pipe is recessed or contained within the body of the device, and wherein a lens or outer portion of the light pipe is positioned such that it is operable to emit light from a rearward portion of the device.

Figure 19:
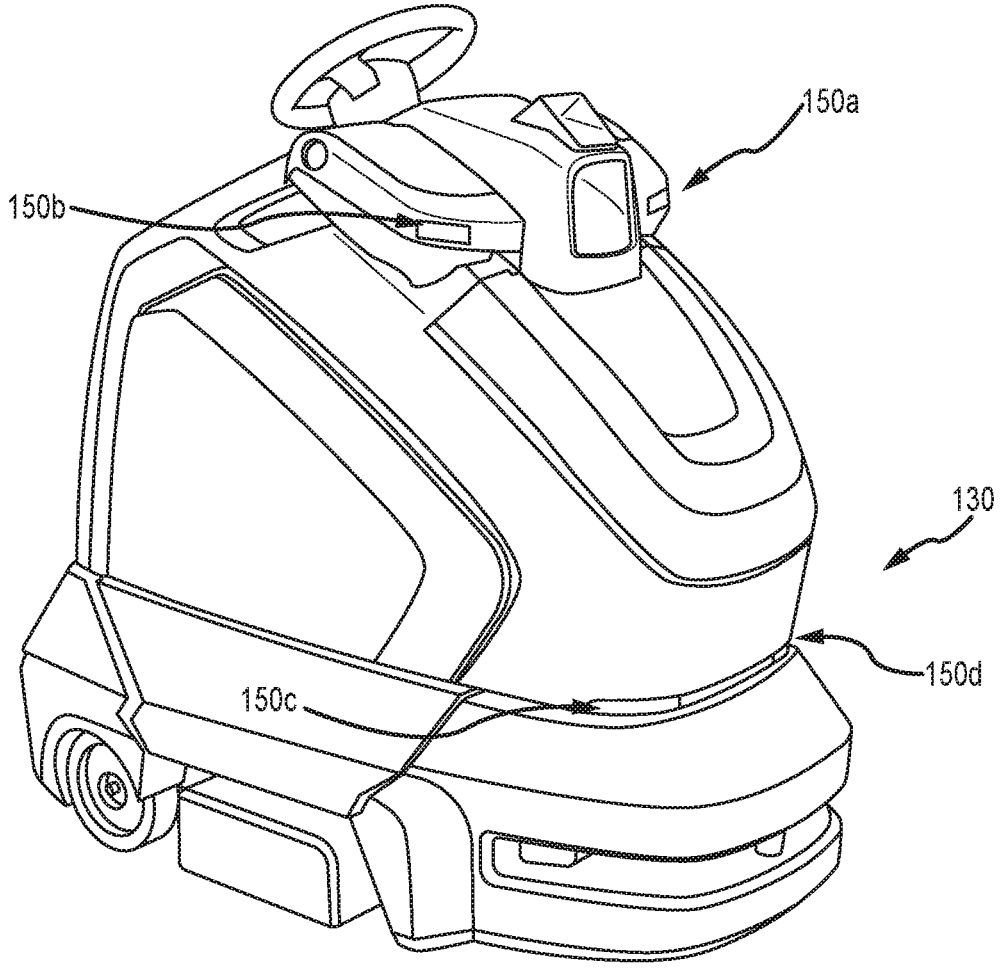
FIG. 19 is a perspective view of a cleaning device with light elements in accordance with one embodiment of the present disclosure.

FIG. 19 is a perspective view of a cleaning device 130 with light elements 150*a*, 150*b*, 150*c*. 150*d* in accordance with one embodiment of the present disclosure. The provision and position of the lighting elements of FIG. 19 are provided for illustrative purposes and to indicate some contemplated positions for lighting elements of the present disclosure. No limitation is provided with respect to the total number, size, or position of lighting elements by FIG. 19. As shown, at least four forward-facing or partially-forward facing light elements 150*a*, 150*b*, 150*c*, 150*d* are provided. The lighting elements are contemplated as comprising various light guide or light pipe structures as shown and described herein, and are capable of emitting various different light colors, patterns, animations, etc.

Figure 20:
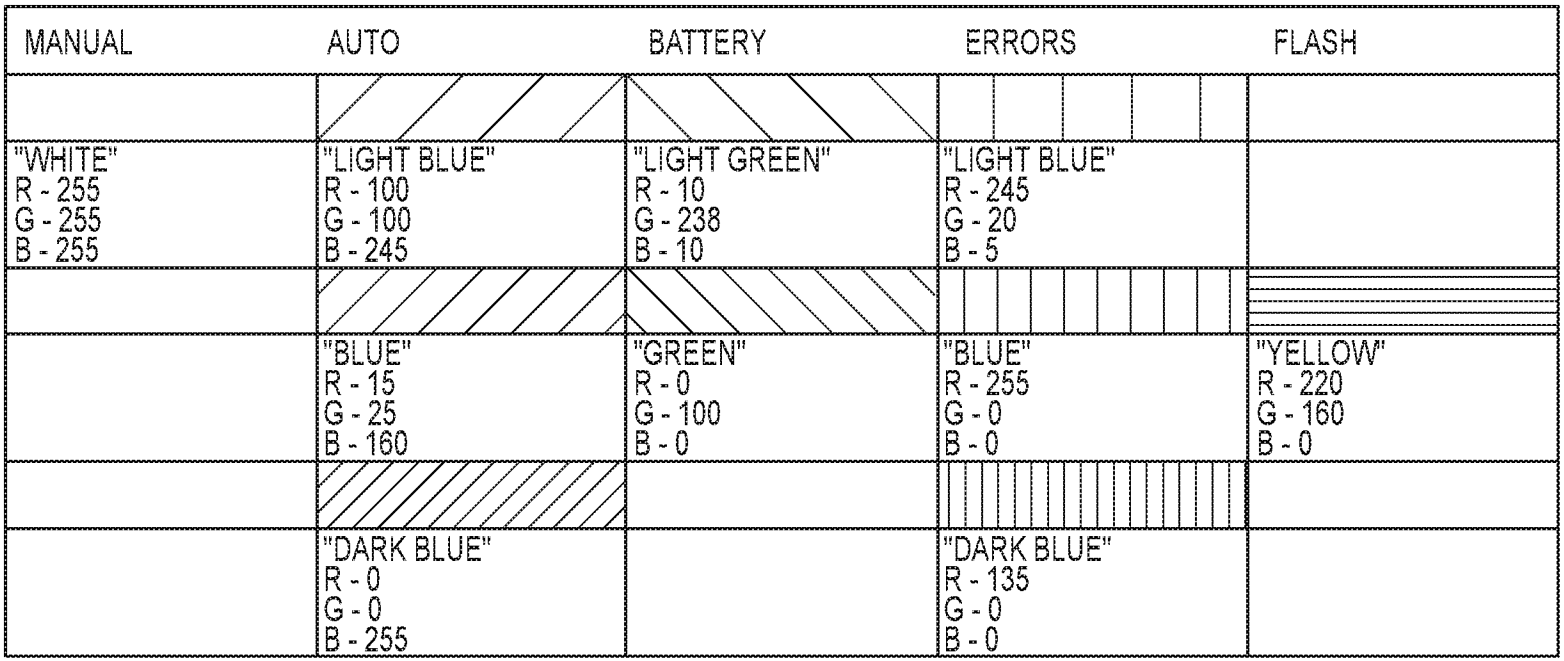
FIG. 20 is a table illustrating various light colors and intensities contemplated by the present disclosure.

FIG. 20 is a table illustrating various light colors contemplated by the present disclosure. As shown in FIG. 20, various different colors are contemplated by the present disclosure and lighting elements as shown and described herein are operable to emit any one or more of the depicted colors, as well as combinations thereof. Different colors are shown as comprising variations in the intensity of component colors (i.e., red, green, blue intensity) and wherein an intensity range for each component color is between 0 and 255. It is also contemplated that certain colors are dedicated to and/or associated with certain information or device functions. For example, various colors in the visible light spectrum are associated with or assigned to convey information related to automatic or normal functioning of a device. In some embodiments, the blue light wavelengths shown in FIG. 20 are emitted when a device is conducting a normal cleaning operation or a normal transit operation. The green light wavelengths are associated with and emitted when the device communicates information related to battery operations (e.g. need for charging, charging complete, etc.). The red light wavelengths are associated with and emitted when errors are encountered (e.g. the device cannot overcome an obstacle, a mechanical fault has occurred, etc.). Visible light in the yellow range is associated with and emitted for purposes of indicated caution or warnings.

Figure 21:
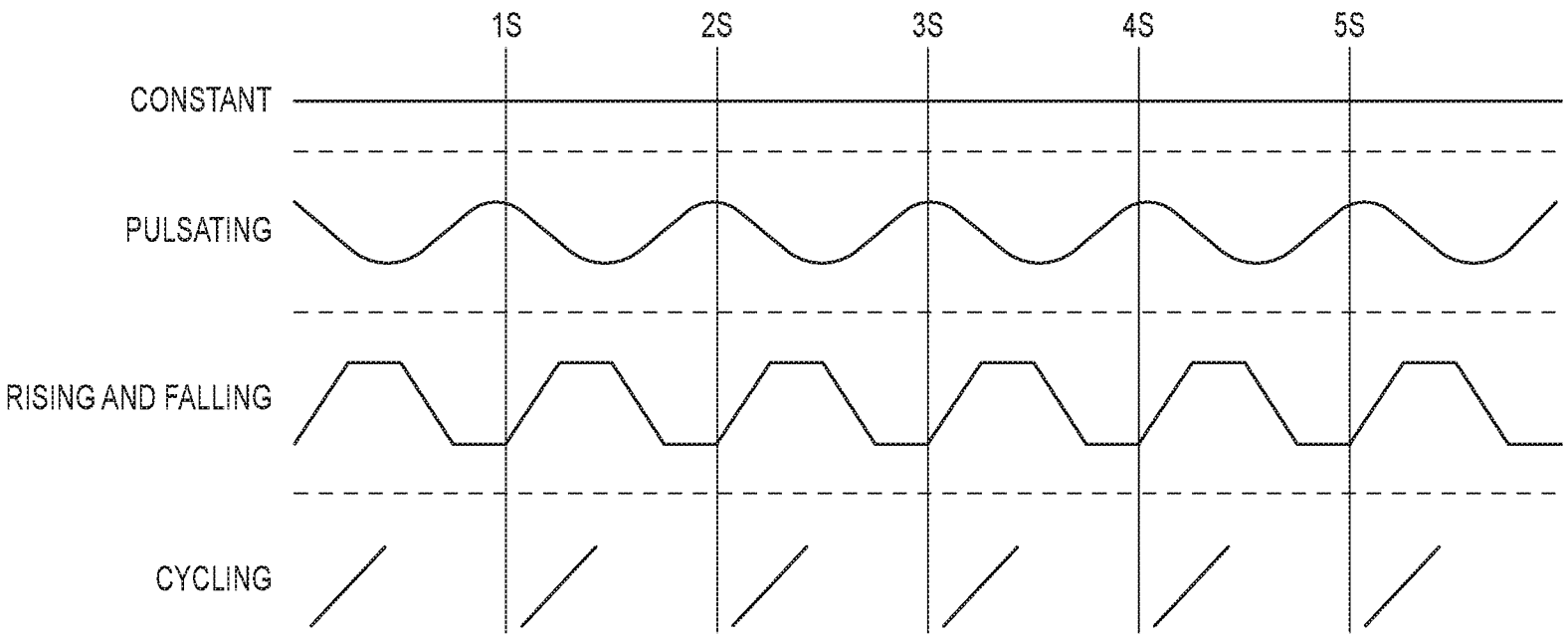
FIG. 21 is a table illustrating different light sequences or animations contemplated by the present disclosure.

FIG. 21 is a table illustrating different light sequences or animations contemplated by the present disclosure. As shown, four distinct light "animations" are provided. As used herein, the term "animation" is intended to refer to a temporal variance in an emission of light. This term includes, but is not limited to, a variance in light intensity or color over time. The light animations shown in FIG. 21 may comprise any one or more of the different colors of the visible light spectrum. Additionally, the four distinct animations shown in FIG. 21 are not meant to be exhaustive, but merely illustrate a few contemplated animations of the present disclosure that may be emitted by lighting elements of the present disclosure. As shown, a constant emission of light is contemplated. The constant emission of FIG. 21 is illustrative as comprising a substantially constant luminosity or intensity for a time period of at least approximately six seconds. Such a constant emission of light is contemplated as comprising various information, depending on the color of light emitted. For example, a constant blue emission is contemplated as indicating that the device is operating normally. As further shown in FIG. 21, a pulsating animation is provided wherein light intensity is continuously varied in a substantially sinusoidal manner. Further, a rising and falling animation is contemplated wherein intensity or luminosity is varied and wherein the intensity is held or paused at maximum and minimum values as shown in FIG. 21. A cyclic or cycling animation is also contemplated wherein light intensity gradually increases or decreases and terminates prior to reinitiating a cycle. Various additional lighting animations are contemplated that are not shown in FIG. 21. For example, various "blinking" animations are contemplated. Blinking may comprise a regular, single flash of light (e.g. at 1 Hz), or may comprise a double-flash, pause, double-flash animation. One of ordinary skill in the art will therefore recognize that no limitation with respect to light animations is provided herewith.

Although the following text sets forth a detailed description of numerous different embodiments, it should be understood that the detailed description is to be construed as exemplary only and does not describe every possible embodiment since describing every possible embodiment would be impractical, if not impossible. Numerous alternative embodiments could be implemented, using either current technology or technology developed after the filing date of this patent, which would still fall within the scope of the claims. To the extent that any term recited in the claims at the end of this patent is referred to in this patent in a manner consistent with a single meaning, that is done for sake of clarity only so as to not confuse the reader, and it is not intended that such claim term by limited, by implication or otherwise, to that single meaning.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention.

What is claimed is:

1. A floor cleaning device capable of autonomous operations and operable to communicate with nearby persons, the device comprising:

a chassis comprising a front, a back, a lower surface, a front surface adjacent the front, an upper surface, a rear surface located behind a center point of the chassis, a left surface, and a right surface;

a platform provided laterally between the left surface and the right surface and wherein the platform is operable to receive a user when the device is selectively operated in a non-autonomous or semi-autonomous mode;

a powered drive-wheel operable to convey the device;

a plurality of multi-colored lights, and wherein at least one of the plurality of multi-colored lights is operable to be illuminated in a manner that corresponds to at least one of an upcoming action and a current status of the device;

wherein the plurality of multi-colored lights comprises at least one rear-facing light element operable to emit light from the rear surface, and at least three at least partially forward-facing light elements, the three at least partially forward-facing light elements comprising at least one at least partially forward-facing light element provided proximal to the upper surface and at least one partially forward-facing light element provided proximal to the lower surface, and wherein two of the three at least partially forward-facing light elements are spaced apart horizontally;

wherein at least one of the plurality of multi-colored lights is incorporated and recessed into a corner of the chassis and comprises a refractive material to diffuse light visible from multiple sides of the device;

wherein the at least one rear-facing light element is provided vertically below the platform and rearward of at least a portion of the platform, and emits light rearward of the platform such that the at least one rear-facing light element is visible when a user is present on the platform; and wherein the plurality of multi-colored lights is distributed horizontally and vertically about the chassis such that emitted light achieves omnidirectional visibility;

a controller operable to cause at least some of the plurality of multi-colored lights to perform at least one of a different pattern and a different animation;

a human machine interface operable to communicate with the controller; and wherein the plurality of multi-colored lights and the controller are operable to produce a unique identifier for each of: an upcoming action of the device, an error status, a task-completion status, a current action of the device, and a warning indication.

2. The floor cleaning device of claim 1, wherein at least one of the plurality of multi-colored lights comprises a light emitting diode.

3. The floor cleaning device of claim 1, wherein the plurality of multi-colored lights is powered by an on-board battery.

4. The floor cleaning device of claim 1, further comprising at least one light pipe for guiding and reflecting light.

5. The floor cleaning device of claim 1, wherein the upcoming action of the device comprises a change in direction of travel of the device.

6. The floor cleaning device of claim 1, wherein the error status comprises an unexpected presence of a human on the device.

7. The floor cleaning device of claim 1, wherein the warning indication comprises an emitted light brightness that is greater than an emitted light brightness for the upcoming action of the device, the error status, the task-completion status, and the current action of the device.

8. The floor cleaning device of claim 1, wherein the human machine interface comprises a graphical user interface.

9. The floor cleaning device of claim 1, wherein the human machine interface comprises a steering wheel.

10. The floor cleaning device of claim 1, wherein the human machine interface comprises a user-interface for controlling the device when the device is provided in a human-controlled mode.

* * * * *